US008408550B2

(12) United States Patent
Walker

(10) Patent No.: US 8,408,550 B2
(45) Date of Patent: Apr. 2, 2013

(54) SYSTEM AND METHOD FOR CARD SHOE SECURITY AT A TABLE GAME

(75) Inventor: Jay S. Walker, Ridgefield, CT (US)

(73) Assignee: IGT, Reno, NV (US)

( * ) Notice: Subject to any disclaimer, the term of this patent is extended or adjusted under 35 U.S.C. 154(b) by 64 days.

(21) Appl. No.: 12/936,642

(22) PCT Filed: Apr. 9, 2009

(86) PCT No.: PCT/US2009/040023
§ 371 (c)(1),
(2), (4) Date: Feb. 7, 2011

(87) PCT Pub. No.: WO2009/126780
PCT Pub. Date: Oct. 15, 2009

(65) Prior Publication Data

US 2011/0130185 A1 Jun. 2, 2011

Related U.S. Application Data

(60) Provisional application No. 61/058,433, filed on Jun. 3, 2008, provisional application No. 61/049,680, filed on May 1, 2008, provisional application No. 61/043,511, filed on Apr. 9, 2008.

(51) Int. Cl.
*A63F 1/12* (2006.01)
*A63F 1/14* (2006.01)

(52) U.S. Cl. ..... 273/149 R; 463/29

(58) Field of Classification Search ..... 273/149 R; 463/29

See application file for complete search history.

(56) References Cited

U.S. PATENT DOCUMENTS

| | | | |
|---|---|---|---|
| 2,185,474 | A | 1/1940 | Nott |
| 2,714,510 | A | 8/1955 | Oppenlander et al. |
| 3,944,230 | A | 3/1976 | Fineman |
| 4,505,404 | A | 3/1985 | Perchak et al. |
| 4,526,752 | A | 7/1985 | Perlman et al. |
| 4,667,959 | A | 5/1987 | Pfeiffer et al. |
| 4,969,648 | A | 11/1990 | Hollinger et al. |
| 5,000,453 | A | 3/1991 | Stevens et al. |
| 5,114,153 | A | 5/1992 | Rosenwinkel et al. |
| 5,189,396 | A | 2/1993 | Stobbe |
| 5,382,024 | A | 1/1995 | Blaha |
| 5,397,133 | A | 3/1995 | Penzias |
| 5,654,050 | A | 8/1997 | Whalen-Shaw |

(Continued)

FOREIGN PATENT DOCUMENTS

WO WO 2009/126780 10/2009

OTHER PUBLICATIONS

International Search Report for PCT/US 09/40023, dated May 28, 2009 (2 pages).

(Continued)

*Primary Examiner* — David L Lewis
*Assistant Examiner* — Werner Garner
(74) *Attorney, Agent, or Firm* — Neal, Gerber & Eisenberg LLP

(57) ABSTRACT

Embodiments include electronic and mechanical improvements to a card shoe adapted to prevent a cheating player from gaining knowledge of the cards within the shoe. In some embodiments, a variety of electronic security solutions are contemplated. In one example, cards may be shuffled at a remote location where the sequence of the cards may be hashed or encrypted and deleted from an external electronic memory. These cards may be sealed with various physical and electronic seals, associated with the hashed value of the card sequence and are shipped to a casino table where they may be inserted into an intelligent card shoe.

18 Claims, 15 Drawing Sheets

U.S. PATENT DOCUMENTS

| | | | | |
|---|---|---|---|---|
| 5,692,748 | A | 12/1997 | Frisco et al. | |
| 5,722,893 | A | 3/1998 | Hill et al. | |
| 5,770,533 | A | 6/1998 | Franchi | |
| 5,779,546 | A | 7/1998 | Meissner et al. | |
| 5,800,268 | A | 9/1998 | Molnick | |
| 5,823,879 | A | 10/1998 | Goldberg et al. | |
| 5,989,122 | A | 11/1999 | Roblejo | |
| 6,165,069 | A | 12/2000 | Sines et al. | |
| 6,267,248 | B1 | 7/2001 | Johnson et al. | |
| 6,346,044 | B1 | 2/2002 | McCrea | |
| 6,582,301 | B2 | 6/2003 | Hill | |
| 6,588,751 | B1 | 7/2003 | Grauzer et al. | |
| 6,651,982 | B2 | 11/2003 | Grauzer et al. | |
| 6,676,127 | B2 | 1/2004 | Johnson et al. | |
| 6,679,777 | B2 | 1/2004 | Pfeiffer et al. | |
| 6,729,621 | B2 | 5/2004 | Moody | |
| 6,755,741 | B1 | 6/2004 | Rafaeli | |
| 6,889,979 | B2 | 5/2005 | Blaha et al. | |
| 6,892,579 | B2 | 5/2005 | Ohtoyo et al. | |
| 6,991,540 | B2 | 1/2006 | Marlow | |
| 7,011,309 | B2 | 3/2006 | Soltys et al. | |
| 7,192,208 | B2 | 3/2007 | Meyerhofer | |
| 7,213,812 | B2 | 5/2007 | Schubert et al. | |
| 7,327,248 | B2 | 2/2008 | Odenwald et al. | |
| 7,341,519 | B2 | 3/2008 | McMain et al. | |
| 2002/0017481 | A1 | 2/2002 | Johnson et al. | |
| 2002/0068635 | A1 | 6/2002 | Hill | |
| 2002/0094869 | A1 | 7/2002 | Harkham | |
| 2002/0113369 | A1 | 8/2002 | Weingardt | |
| 2003/0013510 | A1 | 1/2003 | Vuong et al. | |
| 2003/0195025 | A1 | 10/2003 | Hill | |
| 2004/0023722 | A1 | 2/2004 | Vuong et al. | |
| 2004/0224777 | A1 | 11/2004 | Smith et al. | |
| 2005/0051965 | A1 | 3/2005 | Gururajan | |
| 2005/0062227 | A1 | 3/2005 | Grauzer et al. | |
| 2005/0275537 | A1 | 12/2005 | Kerr et al. | |
| 2006/0014577 | A1 | 1/2006 | Snow | |
| 2006/0094497 | A1* | 5/2006 | Presman | 463/22 |
| 2006/0205472 | A1 | 9/2006 | Sines et al. | |
| 2006/0205508 | A1 | 9/2006 | Green | |
| 2007/0001395 | A1* | 1/2007 | Gioia et al. | 273/149 R |
| 2007/0004499 | A1 | 1/2007 | Gioia et al. | |
| 2007/0015583 | A1 | 1/2007 | Tran | |
| 2007/0134042 | A1 | 6/2007 | Meyerhofer | |
| 2007/0178955 | A1 | 8/2007 | Mills | |
| 2007/0216100 | A1* | 9/2007 | Darder | 273/292 |
| 2008/0111300 | A1 | 5/2008 | Czyzewski | |
| 2008/0272032 | A1* | 11/2008 | Cook et al. | 209/552 |
| 2008/0315517 | A1 | 12/2008 | Toyama | |

OTHER PUBLICATIONS

Written Opinion of the International Searching Authority for PCT/US 09/40023, dated May 28, 2009 (5 pages).

* cited by examiner

SYSTEM AND METHOD FOR CARD SHOE SECURITY AT A TABLE GAME

RELATED APPLICATIONS

The present application claims the benefit of and priority to the following provisional patent applications:

U.S. Provisional Patent Application Ser. No. 61/058,433, filed Jun. 3, 2008 entitled "System and Method for Card Shoe Security at a Table Game";

U.S. Provisional Patent Application Ser. No. 61/049,680, filed May 1, 2008 entitled "System and Method for Card Shoe Security at a Table Game";

U.S. Provisional Patent Application Ser. No. 61/043,511, filed Apr. 9, 2008 entitled "System and Method for Card Shoe Security at a Table Game"; and Each of these applications is hereby incorporated by reference in its entirety.

FIELD OF THE INVENTION

The present invention is directed to increasing security of shuffled cards at a table game.

DETAILED DESCRIPTION

Figure 1:
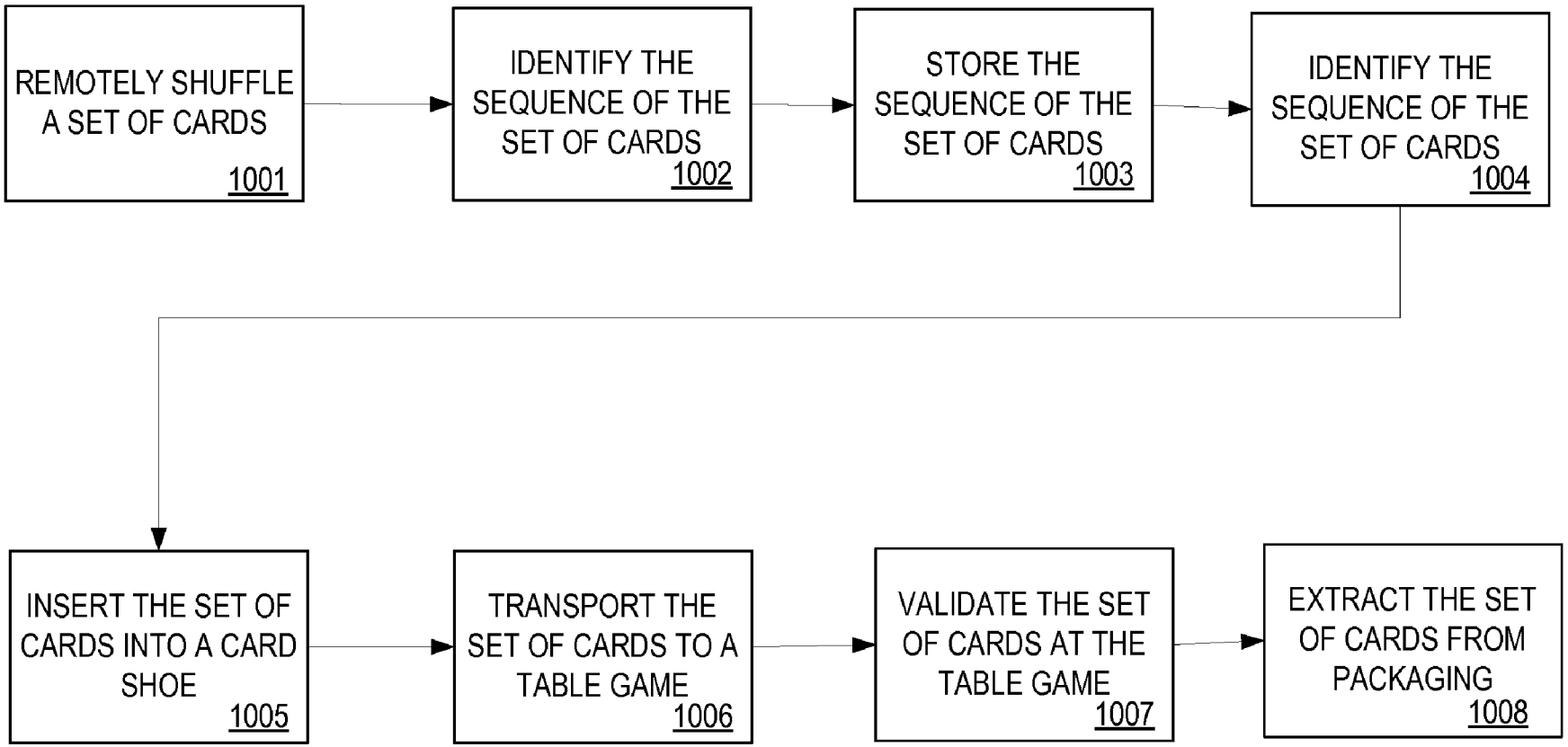
FIG. 1 illustrates an example embodiment of a method of preserving the integrity of a shuffled set of cards.

Embodiments include electronic and mechanical improvements to a card shoe adapted to prevent a cheating player from gaining knowledge of the cards within the shoe. In some embodiments, a variety of electronic security solutions are contemplated. In one example, cards may be shuffled at a remote location where the sequence of the cards may be hashed or encrypted and deleted from an external electronic memory. These cards may be sealed with various physical and electronic seals, associated with the hashed value of the card sequence and are shipped to a casino table where they may be inserted into an intelligent card shoe. The intelligent card shoe may contain a variety of electronic apparatus to receive the hashed value of the card sequence as well as to optically scan each of the cards as they leave the shoe. The cards may be scanned and/or recorded as they exit the shoe, the order of which may be compared with the received hashed sequence of the cards; the casino may be alerted if the card order has been corrupted or the security of the shoe has been compromised. In some embodiments, the hashed sequence may be stored behind tamper-proof or tamper-evident security solutions so that the sequence of cards or position of individual cards cannot be detected without compromising or breaking an electronic or mechanical seal that would alert an observer that the shoe's integrity may have been compromised.

Conventional security measures at casinos are generally measured for cost-effectiveness; that is, the cost of a security measure may be compared against a risk of loss if that security measure is compromised. Multiple security measures may be combined together to increase redundancy and to provide a plurality of data points to more easily detect security breaches. Most casinos also have betting limits in a range that even if all security measures are evaded, the total loss may still be limited to an acceptable amount for standard bets, making many additional security measures beyond the conventional security measures cost-prohibitive.

As potential short term winnings at table games increase with respect to table limits, however, the risk of short term loss becomes much higher, as does the risk of a cheating player attempting to gain access to cards. For example, potential winnings may increase when "long shot" bets are permitted at the same limit range as standard bets. Standard baccarat bets are arranged such that the total potential loss for the casino is limited to an amount equal to or less than the amount bet by the player for a given bet, i.e., standard baccarat bets are equal to or slightly less than 1:1. Thus, if a maximum bet is $10,000 at a particular table, the casino cannot lose more than $10,000 on a single bet of standard Baccarat. Bets with longer odds may also be included, e.g., placing a late bet on the player with four cards showing, with the banker a prohibitive favorite, and these bets may be offered at the same limits as conventional bets to induce action. However, although the house edge may be set at a higher level than standard baccarat bets to make these bets better for the casino in the long term, the potential payout (and loss for the casino) may be much higher in the short term, because the potential payout on a winning "longshot" bet may orders of magnitude higher than 1:1. The incentive to cheat greatly increases in these and other situations where potential loss to the casinos is especially high.

A variety of physical and mechanical security embodiments are also herein explored. A variety of methods and apparatus may be used to prevent a cheating player from physically tampering with or gaining advance knowledge of the order of a shoe. For instance, cards may be sealed in a specially designed container having tamper-evident seals that can be opened mechanically by an intelligent shoe. Thus, the shoe can verify that no seals have been broken, and can then open the seals without ever involving human contact with the cards prior to dealing. Similarly, sets of cards may be visually designed such that it would be highly noticeable if one or more cards were out of place or inserted/extracted. By combining one or more physical and mechanical security measures and/or one or more electronic security methods described herein, casinos may tighten card shoe security and be confident that no player is gaining an unfair advantage over the house.

The term "remote shuffling facility" may refer to a facility where a set of cards to be used at a table game are prepared and which is away from a table game where the set of cards is to be dealt. Preparation steps performed at a remote shuffling facility may include, but are not limited to: shuffling a set of cards; determining a sequence for the set of cards; determining an indication of the sequence; storing an indication of the sequence; transmitting an indication of the sequence; packaging the set of cards; sealing the set of cards; placing cards in a card shoe; packaging the card shoe; sealing the card shoe; shipping the cards or shoe.

The term "card sequence" may refer to an indication of the contents and/or order of a physical set of shuffled cards. The card sequence may be an electronically stored indication of the card sequence, and may be encrypted using one or more methods including: a cryptographic hash function, a public key encryption algorithm, a symmetric key encryption algorithm, a stream cipher, a block cipher.

The term "set of cards" may refer to one or more decks of cards or other group of cards. The set of cards may be ordered or shuffled, i.e., in random order.

The term "housing," "receptacle" and/or "container" may refer to a device that receives a set of cards for movement and/or transport, e.g., from a shuffler to a shoe. The device may be sealed using physical and/or electronic methods to prevent access and/or tampering. A housing may be rigid and may also or alternatively comprise flexible packaging.

Some embodiments employ "intelligent card shoes" which may have the capability to optically scan or otherwise detect and record the rank and suit of each card that is dealt from the shoe. These shoes may also comprise processing devices to organize and process data, input/output devices (e.g., a microphone; speakers; biometric sensors; a keyboard or keypad; individual hard or soft buttons; an LED; an LCD; a touch screen; a PDP; an electroculogram; voice recognition software; etc.), an automatic shuffler and/or a connection to an external computing device, displays and/or a network. These components may all be used in the methods and apparatus described herein to make a card shoe more secure by validating the security of an already shuffled set of cards placed inside an intelligent card shoe; and also validating the security of a shoe by comparing the rank and suit of cards leaving the shoe to a stored indication of the shuffled card's sequence.

Various existing technology can be used and modified to perform the functions mentioned above, such as the iShoe™ Intelligent Shoe manufactured by ShuffleMaster INC; the IS-B1™ Intelligent Shoe manufactured by ShuffleMaster INC.; and the AccuPLAY™ Intelligent Card Shoe Manufactured by TCS JOHNHUXLEY. A variety of issued patents and applications may also be used with embodiments described herein, including: U.S. Pat. No. 5,722,893 to Hill et al. (includes descriptions of methods of how to identify the value of a card using a scanning device built into a card shoe); U.S. Pat. No. 6,886,829 to Hessing et al. (a card shoe with built-in imaging device and the ability to interface with, and display information to, a dealer); U.S. Pat. No. 7,213,812 to Schubert et al. (a card shoe with built-in scanning device and an automatic shuffler); and US Patent Application No. 20050062227 to Grouzer et al (a card shoe with parts capable of moving cards within the shoe, scanning the cards within the shoe and transmitting such information to a processor. The descriptions of intelligent card shoes associated table games in these patents/applications are incorporated by reference herein for all purposes.

Embodiments also include "smart gaming tables" utilizing display devices or other table game input/output interfaces (e.g., touch-sensitive screens, CRT screens, LCD screens, keypads, motion detecting sensors or mice, an electroculogram input device, voice recognition software, etc.) embedded within and/or otherwise associated with a table game for the purposes of (i) alerting a dealer or other casino personnel that the cards in a card shoe, or the entire shoe itself has been compromised or tampered with, (ii) displaying game or dealing instructions to a player or a dealer, (iii) receiving input about a game situation or a validation confirmation from a dealer or other casino personnel, and (iv) displaying statistics about the cards that have been dealt to a player or a dealer. Various technologies described in the following patents and patent applications may be used with embodiments described herein: U.S. Patent Application Publication No. 2006/0205472 to Sines et al. (touch-screen displays allowing player/dealer input at table games); U.S. Patent Application Publication No. 2006/0014577 to Snow (player-specific push buttons and display screens in communication with a table game computer); U.S. Pat. No. 7,341,519 to McMain et al. (providing a player interface display at a table); U.S. Pat. No. 5,779,546 to Meissner et al. (outputting instructions to a dealer via a display screen). The descriptions of interfaces and displays embedded within or associated with table games in these patents/applications are incorporated by reference herein for all purposes.

Some embodiments include smart gaming tables utilizing computing devices (e.g., a "table computer", a "central table server", PC) at or networked to a gaming table for the purposes of (i) recording information received by an intelligent card shoe (e.g., playing card values, the position they were dealt to, and the sequence in which they were dealt), (ii) processing such recorded information and to comparing it to a known sequence, a hashed value of a known sequence, an encrypted hash of a known sequence, an encrypted value, etc) and/or (iii) generating one or more messages or instructions (e.g., a validation message output based on said comparison, instructions to the dealer regarding a dealing sequence, etc).

Various technologies described in the following patents may be used with embodiments described herein: U.S. Pat. Nos. 7,011,309 and 6,652,375 to Soltys et al. (optical scans of playing cards are taken as they exit a card shoe, which information is recorded and logged by the table's computing device). The descriptions of processing devices associated with a table game in these patents are incorporated by reference herein for all purposes. For additional information, examples of existing products using computers to track, store and analyze dealt cards include: the Table iD™ Table Management System manufactured by Progressive Gaming International Corporation and Bally's TMS™ From Bally Gaming Incorporated.

Some embodiments may include a basic card shoe (e.g., a card shoe without electronic devices such as scanners or processors) such as those currently used in card games such as blackjack and baccarat. Such a shoe may be designed to hold multiple decks of cards; many blackjack or baccarat shoes currently hold 6-8 decks. The present disclosure may discuss modifying a one or more standard card shoes such that they provide enhanced security features, for example, basic card shoes may be made completely transparent such that the contents of the shoe are always visible (e.g., unique designs printed on a set of cards). Examples of such shoes are well known and commonly used in many casinos.

Some embodiments may include automatic shuffling devices. Such a device may have the ability to receive one or more decks of cards, shuffle the cards into a random sequence and dispense the randomly ordered set of cards. Additionally—and for purposes of some operations described herein—such a device may also be able to determine the value of each card within the set while the cards are still within the device. Therefore, cards may be shuffled and the sequence of the shuffled set may be determined and used to validate each card as they are dealt from an intelligent card shoe. The shuffler may use a variety of known methods for determining the value of each card, such as optical character recognition (OCR) or recognition of machine readable indicia printed on the cards. The MD2™ Shuffler from Shuffle Master™ is an example of such a device.

The shuffling device described above may be used by a Remote Shuffling Facility when preparing cards to be transported for use at a casino. For example, the cards may be shuffled and the sequence may be automatically determined, which sequence may also be encrypted by a processing device (e.g., a processing device may be a component of the shuffler or a separate device). In other embodiments, the shuffling device may be used directly at a gaming table when preparing cards to for a card game, discussed in detail below.

In some embodiments, entire card shoes and/or a shuffled set of cards to be inserted into a card shoe may be protected by an electronic seal (e-seal). Some embodiments may include shuffling cards in a remote facility and sealing them before shipping the cards to a casino for use. These embodiments may prevent outside observation of the process in order to prevent anyone from discovering the card sequence in advance. In some embodiments, the shuffling process is entirely automated within a lightless compartment; one or more cameras may be located inside the shuffling compartment to verify that no cards are visible during the shuffling process.

In order to ensure that the cards have not been observed or tampered with, an e-seal may be placed inside or around a card shoe or a set of shuffled cards to be inserted into a card shoe. Such a seal may be able to detect if the seal has been tampered with and warn casino personnel if the shoe's security has been compromised. For example, an e-seal may comprise sensors used to detect a change in environmental conditions inside or around a container. This information is then stored in memory associated with the e-seal, and transmitted to another device using one or more methods of communication (e.g., the e-seal may be physically connected to a processor, such as via a USB port or the e-seal may wirelessly transmit information, such as via a WIFI connection). In some embodiments, all physical and electronic information that could be used to identify the card sequence may be enclosed behind this or another tamper resistant and/or tamper evident seal.

For more information about electronic/RFID seals, see U.S. Pat. No. 5,189,396 to Sobbe (an electronic seal device that records information related to unauthorized breaks or changes in the seal); U.S. Pat. No. 7,327,248 to Odenwald et al. (an electronic seal device that detects changes in environmental conditions around or inside a sealed container and transmits the changes to a processor); and US Patent Application 20050275537 to Kerr et al. (an object lined with conductors connected to a sensor that detects change in conductivity that is evident of tampering). The descriptions of electronic/RFID seals in these patents/applications are incorporated by reference herein for all purposes. Additional information about electronic/RFID seals may also be found in the following documents, which are also incorporated by reference herein for all purposes: Barlas, Stephen, ISO Reconsidering E-Seal Specification; RFID Journal, found online at: www.rfidjournal.com/article/articleview/1696/(Jul. 1, 2005); Savi Announces 6 RFID E-Seal IP Licenses; RFID Update, found online at: www.rfidupdate.com/articles/index.php?id=1416 (Aug. 6, 2007).

Figure 2A:
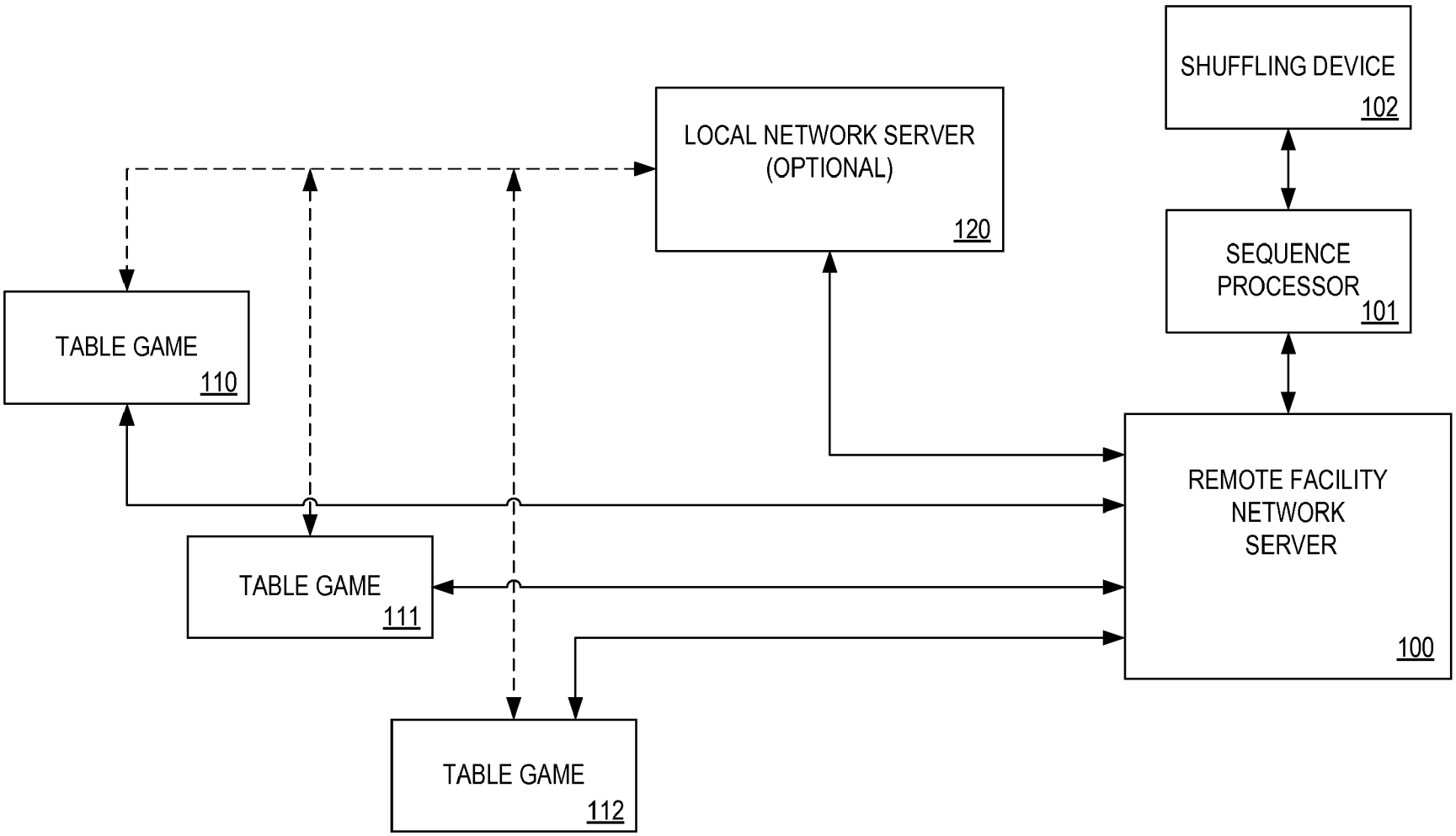
FIG. 2A-2B illustrates an example embodiment of remote shuffling systems that may employ an automatic shuffling system via networked and local computing devices.

Some embodiments include a secure network connecting the remote facility with devices used at a table game. Referring to FIG. 2A for example, Remote Facility Network Server 100 is connected to Shuffling Device 102 and Sequence Processor 101, which may be used to gather sequence and card set identification information (discussed in detail below). This information may be received by Remote Facility Network Server 100, which is connected directly to Table Game 110, 111 and 112 at a casino. Devices at these table games that may be in communication with the Remote Facility Network Server 100 include: a table game computer or processor, an intelligent card shoe, a display device or an interface device. Shown as an optional component in such a network is a Local Network Server 120, which may be a local server existing for the purposes of the methods discussed in this disclosure (and thus independent of the casino's network). In other embodiments, Local Network Server 120 may be a part of the casino's network system. In either embodiment, Local Network Server 120 may receive and route information to the appropriate table game, or may store information which may be retrieved by each individual table game.

Some embodiments describe methods for remotely preparing a card shoe and/or a set of cards to be inserted into a card shoe. For example, after preparing the cards/shoes remotely, the card sequence may be encrypted and associated with the cards/shoe; after which the cards/shoe are packaged, fitted with an e-seal and shipped to a casino for use. After the e-seal has been validated at a table game, the cards/shoe may be unpackaged and unsealed for use. During the game, the encrypted card sequence associated with the cards/shoe may be compared to the order of the cards dealt at the table to ensure security has not been compromised. The encrypted sequence may be stored behind the e-seal or other seal in situations where a casino or other party desires that no one have access to any information relating to the card sequence prior to use of the shoe at the table game.

By remotely shuffling, packaging, and shipping the shoes in a sealed compartment, the integrity of the shoe is protected from attempts at cheating. For instance, even if a person were somehow able learn the sequence of and/or alter a set of shuffled cards and repackage them en-route to a casino, it would be very difficult for that person to be present and playing at the exact table and time where/when the cards are used at a casino. However, when potential losses are extremely high, even a tiny risk of cheating can justify additional security measures that might not be otherwise necessary.

As shown in FIG. 1, a number of steps may be taken when preparing various components of the present disclosure for use at a table game. As discussed below, these steps may be executed in any order. Some steps may be optional. Other steps and methods are also contemplated.

Step 1001: Remotely Shuffling a Set of Cards. A company supplying a casino with secure sets of cards and/or shoes may use a shuffling machine to randomly order one or more decks of cards. In some embodiments, the shuffling machine will receive a randomly generated sequence and order the cards according to said sequence—in others, a shuffling machine may randomly shuffle the cards. Though many embodiments describe remote card preparation occurring at a third party location outside of the casino, remote preparation may occur within the casino as well. For example, cards may be shuffled and prepared in a "back-room"—somewhere off of the casino floor. It should be noted that any of the following steps involving a remote facility may be performed in a "back-room" as well.

In some embodiments, unique or identifying indicia may be printed on one or more cards. Such embodiments are described in more detail below. In some embodiments, a variety of other physical qualities associated with a set of cards may be modified—methods for modification are described in detail below, and include: printing cards with disappearing ink, physically linking each card in a set with one another, printing cards with invisible indicia that is exposed at a table game, printing a redundant card shoe, etc. Methods for printing indicia on playing cards may be found in U.S. Pat. No. 5,654,050 to Whalen-Shaw, the relevant portions of which are incorporated by reference herein.

Step 1002: Identify the Sequence of the Set of Cards. In some embodiments, the sequence of the shuffled set of cards may be identified. The sequence may be identified by scanning each card separately and recording the face value of each scanned card. In some embodiments, the step of identifying the sequence of a set of cards may be performed while/after the cards are being shuffled. In other embodiments the sequence of a set of cards may already be known, such as in embodiments where the cards are potentially ordered in a predetermined random order.

Step 1003: Store the Sequence of the Set of Cards in a Predetermined Format. In some embodiments, a representation of the sequence of a set of cards may be stored and associated with the physical set of cards. In some embodiments, the representation of the sequence may be encrypted in order to protect the sequence from being discovered by a cheating player. Examples of sequence encryption include converting the sequence into a hash value or an encrypted hash value. This information may then be associated with a set of cards and stored in a device for later use.

Step 1004: Package and Seal the Set of Cards. In some embodiments, the cards may be packaged and sealed. A variety of different methods of packaging and sealing a set of cards are contemplated and described below. For example, cards may be sealed in a coating or a container comprising electronic sensing devices connected to an e-seal with the ability of detecting one or more changes in environmental conditions. If the cards are tampered with, the sensors may detect the security breach and store an indication of the breach in memory. Further, packages of cards may be fitted with wireless transmitting devices (e.g., RFID or WiFi tags) comprising a unique identifier for each package.

Step 1005: Insert the Set of Cards into a Card Shoe. In some embodiments, a set of shuffled cards may be placed directly into a card shoe after shuffling. The entire shoe may then be packaged and sealed in a manner similar to that which is discussed directly above. Thus, instead of preparing and packaging individual sets of cards to be inserted into a card shoe at a table game, an entire shoe may be prepared and packaged to be used at a table game. For example, at a table game, whenever a dealer reaches the cut card in a card shoe, instead of replacing the cards within the shoe, he or she may replace the entire shoe instead. Old shoes may then be sent back to the remote preparation facility to be refilled with a securely shuffled set of cards.

Step 1006: Transport the Set of Cards to a Table Game. Once the cards have been prepared remotely, they may be transported to a casino or to a table game within the casino. In some embodiments, cargo containing packaged sets of cards may be checked with a wireless sensor to determine that all packages of cards are accounted for and have not been removed or tampered with at any time during transport.

Step 1007: Validate a Set of Cards at a Table Game. When a set of cards are ready to be used at a table game, a processor at the table (e.g., a portable validation device operated by casino personnel, a table computer, a processor in an intelligent card shoe, etc.) may check the e-seal to determine if the security of the set of cards has been compromised. In another embodiment, a processor may determine (i) sequence information from the set of cards or (ii) identification information associated with the set of cards such that an associated card sequence can be retrieved (e.g., the processor may query a database of card sequence information). The stored card sequence may then be compared with the physical sequence of the cards (e.g., cards may be scanned within the shoe or as they exit the shoe), to determine the physical order is valid. Once a set of cards has been validated or invalidated, a message may be generated and output at the table, to security personnel, to casino management, to the remote shuffling facility, etc.

Step 1008: Extract a set of Cards from Packaging or a Sealed Container. The packaging for a set of cards may be opened automatically by and within a card shoe in order to avoid human interaction with the physical set of cards. A variety of methods discussing such embodiments can be found below.

Below are detailed descriptions of methods and apparatus that may be used to protect and preserve the integrity of the cards within a card shoe. These security measures may include electronic, mechanical or a combination of security measures. Electronic security describes ways to secure a shoe of cards using electronic devices and data. Mechanical security describes physical apparatus and game object modifications to protect a card shoe.

In some embodiments, an intelligent card shoe comprising scanning devices and processors may be used to validate the sequence of a remotely prepared set of cards. As described above, cards may be shuffled and prepared at a remote location before being shipped to a casino for use. Cards may be shuffled by a human or by one or more card shuffling machines (e.g., the MD2™ Shuffler manufactured by ShuffleMaster INC.). If the shuffling is done manually, the shuffler may put the cards into a scanning device that scans each card to determine a sequence. If the shuffling is done by an automatic shuffler, such a device may be equipped with a sensor to read and detect the sequence of the cards as they are being shuffled or after the shuffling is completed. Because the present disclosure is focused on protecting information about shuffled cards, the sequence of a set of cards may be converted to, and stored as, encrypted data. For example, the remote facility may perform the process of storing encrypted data indicative of the value of at least one card in the shoe wherein the encrypted data is produced via one or more of the following: a cryptographic hash function, a public key encryption algorithm, a symmetric key encryption algorithm, a stream cipher, a block cipher. The remote facility may also store encrypted date wherein the encrypted data is indicative of the entire sequence of a shuffled set of cards, wherein the encrypted data is indicative of only a subset of a shuffled set of cards, or wherein the encrypted data is indicative of each single card within a set of shuffled cards. (e.g., there is an encrypted value for each individual card).

In some embodiments, as soon as a sequence has been encrypted, the original unprotected sequence data may be permanently deleted from memory. For example, cards are shuffled and an optical reader of the shuffling device(s) reads the data from the cards and stores the sequence temporarily in RAM. As soon as the full sequence is learned, an algorithm encrypts the sequence into a hash value. The hash value is then stored in ROM, and the sequence is dumped from the RAM a few seconds after it is entered, such that it is never permanently stored. Since the full sequence is not ever stored anywhere in memory, it may be difficult or impossible for those without the proper decryption scheme to learn the shoe's sequence (e.g., a person could not hack into a computer at the remote shuffling facility and learn the sequence of cards). Learning the shoe's contents would therefore require either, (i) hacking the RAM to hijack the sequence data, (ii) figuring out the decryption algorithm, or (iii) tampering with the physical set of cards.

In another example, instead of storing any sequence information in memory, the shuffling device may create encrypted data as it scans each separate card value of the shuffled set (i.e., not ever determining or storing an entire sequence, only the values of individual cards). The term "sequence", as used below, may describe the sequence of a shuffled set of cards in any data form. For example, the term sequence may be used to refer to: the actual sequence of a set of cards; a hashed value of a sequence of a set of cards; an encrypted hash value of a sequence of a set of cards; a public key encryption algorithm; a symmetric key encryption algorithm; a stream cipher; a block cipher; etc.

The sequence of a set of shuffled cards may be associated with a unique identifier of a card shoe or a set of shuffled cards. For example, each set of shuffled cards is assigned an identifier (e.g., a serial number, a bar code, an alphanumeric code, etc.), an identifier may be printed on the packaging of the cards or the shoe, an identifier may be stored in an electronic device packaged with the cards or the shoe (e.g., an e-seal, a wireless transmitting device, a USB flash drive, etc.), or an identifier may be printed on a first blank card in the shoe (e.g., to be read by an intelligent shoe's scanning device). In some embodiments, an identifier may be stored in a database associated with a card sequence Once the sequence of a set of cards has been determined, encrypted and associated with a set of cards, it may be stored in one or more devices. For example, the sequence and the identifier of the associated set of cards may be stored in a database at the remote shuffling facility or the sequence and an associated card set identifier (and any other necessary information) may be transmitted by the remote shuffling facility directly to one or more devices at a casino. Sequence and identifier information may also be stored on physical medium (e.g., a hard disk, a flash drive, a CD, a DVD, etc.) and uploaded onto such devices.

In other embodiments, data may be transmitted across a network connecting the remote shuffling facility to devices at the casino. For example, referring back to FIG. 2A, the sequence and identifier may be sent by Remote Facility Network Server 100 to Local Network Server 120. Then, devices at a table game such as Table Game 110, 111 or 112 may use and retrieve this information via a network connection to Local Network Server 120. In some embodiments, devices at a table game may be directly connected via a network to Remote Facility Network Server 100 (as opposed to relying on a casino's network). Devices at the table game capable of interfacing with such a network data include: a table computer, portable validation device, an intelligent card shoe, etc. For example, the sequence and identifier may be printed on a first blank card in the shoe (e.g., to be read by an intelligent shoe's scanning device) or the sequence may be stored in the memory of an electronic seal device. In such an example, the electronic seal may serve a dual purpose—to detect any unauthorized tampering with a set of shuffled cards and to store and transmit the sequence of a set of shuffled cards to a processing device at a table game (e.g., a table computer, a portable validation device, a processor within the card shoe, a processor on a casino network, etc.)

In some embodiments, the sequence of the cards may be locked in a portable memory attached to the cards. For example, within the packaging of a set of shuffled cards, a USB flash drive may store the sequence of the cards or an identifier of the shuffled set of cards. In another embodiment, a wireless device may contain an identifier or the sequence, such as a WiFi or RFID transmitter.

As mentioned above, a set of cards may be prepared and shipped to a casino by themselves or, in some embodiments they may be placed in a card shoe (basic or intelligent) and shipped to a casino together. Many disclosed methods of implementation are discussed in the context of preparing only the set of cards and shipping them sans shoe—the card set is then inserted into a shoe at a table game for use. However, in many embodiments, an entire shoe containing cards may be prepared as well and that instead of replacing the cards within the shoe at a table game, the entire shoe may be disconnected from the table and replaced. Therefore, when the following steps mention a "set of cards", "cards", a "shuffled set of cards", "prepared cards", etc. it should be noted that this may refer to a card shoe as well, even when not explicitly stated.

Once sequence and identifier information is made available to devices at the casino and more particularly devices at the table game where a set of cards are used, this information is obtained by the device so that it can be compared to the physical sequence of a card set. For example, when a set of cards is inserted into a shoe (or a prepared shoe is connected to a table game's processor) the identifier for that set of cards may be determined. This identifier may be used by a table game device to retrieve sequence information from a database storing identifiers with associated sequence information. For example, a card shoe may determine that it has just been loaded with card set "129393". The card shoe may then reference a database (contained on a table computer, within a processor at in the shoe, on a casino or remote facility server, etc.) to obtain sequence information associated with card set "129393".

In other examples, a device at the table may read a bar code on the set of cards, a serial number or other visible identifier may be automatically scanned or entered into one or more interfaces at the table game (e.g., an interface on the card shoe, a dealer interface, a pit computer, etc.), the shoe may be physically connected to one or more devices containing identifier information, such as a flash drive or an e-seal associated with the card set, or the shoe may be wirelessly connected to one or more devices containing identifier information, such as an RFID tag or a wirelessly transmitting e-seal. Rather than looking up the sequence information in a database, one or more components of the card set may comprise stored sequence information (as described above), in which case the information may simply be received via such device.

The stored sequence information may then be compared to a determination of the card set's physical sequence. In order to determine the card set's physical sequence, the intelligent card shoe comprises a scanner that can scan each card in the set. In some embodiments, reading the card set may comprise reading cards as they exit the shoe. In such an embodiment, as each card is pulled out of the shoe, it is scanned and compared with the stored sequence information. If the stored sequence information does not match, the card set is invalidated. In some embodiments, in order to prevent a situation where a player is dealt a card that has been invalidated, the cards may be read within the shoe before they are provided to the dealer. For example, when a dealer pulls a card from the shoe, the next card is scanned, and pushed to the opening of the shoe. Similarly a dealer may request a card by pressing a button, causing a card to be scanned before being provided to the dealer. In such embodiments, if the card sequence is invalidated because the comparison does not match, then the card is not provided to the dealer. In some embodiments, reading the card set may comprise reading the entire deck all at once, prior to any cards being dealt. In such an embodiment, the card shoe may scan each card placed inside and compare the determined physical sequence with the stored sequence information. If any card value does not match the stored sequence value, then the entire deck is invalidated.

When comparing the physical set of cards to a stored sequence, each individual card may be compared to sequence information associated with a single card (e.g., an individual hash value for that specific card) or it may be compared to sequence information associated with the entire card set (e.g., a hash value representative of the sequence of the entire set).

Once the physical sequence has been determined to be valid or invalid, a validation message may be output, e.g., one or more output devices may tell casino personnel if a card set is valid or invalid. Messages may be published on the dealer screen or a system of LED's may be embedded in the table letting the dealer know whether or not to proceed with the game. An indication may comprise a visual or audio output. For example, an LED may flash at the table to let the dealer know he or she may proceed. In another example, an audible message such as a siren may be output at the table when payout information or amounts are invalidated. For example, a green light may indicate to a dealer that everything has been validated and he or she may proceed with the game; a yellow light may indicate to a dealer that the system is currently validating sequence information, and so he or she must wait before proceeding; a red light may indicate to a dealer that one or more of the sequence information has been invalidated and he or she must wait for security assistance.

In another embodiment, the shoe could turn off access to cards if the card set is invalid. The dealer would be unable to deal until a pit boss or other security personnel came by and authorized the shoe to allow cards to be dealt. Invalidation messages may also be sent to a variety of entities other than those at the physical game, for example a message may be sent to the remote facility (the supplier of the card set), casino security personnel, casino management, etc. After invalidation occurs, one or more security measures may be triggered.

In some embodiments, when a dealer pulls a card from the shoe, he or she may be required to wait for a validation/invalidation message (e.g., any of the ones discussed above) before providing the card to a player or flipping the card over. For example, each time a card is pulled from the shoe, either a red LED or a green LED is flashed. If the red LED is flashed, the dealer must not flip the card. If the green LED is flashed, the dealer can proceed with the game.

In some embodiments, when a card is invalidated, the card shoe automatically locks and no other cards can be pulled from it. For example, any information collected or processed by devices at the game while a shoe is was in use may be automatically transmitted to one or more people or locations, e.g., to the remote facility, to casino security, a pit computer, to casino management, etc. For example, any images recorded by security cameras starting the beginning of the use of a shoe may be automatically retrieved and sent to any of the above locations. Besides images of the table game being played, any images from the captured of the vicinity of the table game being played may also be retrieved and transmitted. For example, all of the activity occurring at a table game may be automatically tracked by one or more devices. All of this information may be sent to one of the above locations and used as evidence against a potential cheater. For more information about collecting information and activity at a table game, see co-owned U.S. Provisional Patent Application No. 61/031,191, filed Feb. 25, 2008, the entirety of which is incorporated by reference herein. In some embodiments, invalidation may cause one or more doors to lock. In some embodiments, invalidation may cause one or more security personnel to come to the table. In some embodiments, invalidation may cause one or more security cameras to activate and capture multiple strategic images at the table game. Potential image targets include, any images of a player at the table, any images of casino personnel near the table, any objects on or near the table, etc. In some embodiments, invalidation may cause all bets to be recorded and frozen by the casino, e.g., no one is able to touch the bets at the table until the problem is resolved. In some instances, the hand may be called dead and all bets may be returned. In other instances, the bets remain live and the rest of a hand is dealt from a new set of cards or another shoe.

In some embodiments, casinos may be equipped with video footage of cards leaving a card shoe to be sure that an invalid card has not been introduced to the game after the deal. For example, cheating players or dealers may attempt to substitute false cards or introduce invalid cards after dealing has taken place. In such a situation, the card shoe may recognize the card that left the shoe as valid, however an invalid card may appear on the table. To combat such attacks, casinos could playback video of cards being drawn from the shoe in order to resolve discrepancies at a table (and later on as well).

As discussed above, card shoes may have imaging capability. Card Shoes with scanning and imaging capability are well known in the art; see U.S. patent application Ser. No. 11/558,823 to Czyzewski—which is incorporated by reference herein—for more information on card shoes with built in scanning and imaging technology. Imaging devices may comprise a panel that emits ultraviolet lighting in order to capture images in low lighting. Additionally, images may be video or still, and may also be time stamped to further prove authenticity.

If a casino feels the need to justify or to prove that a particular card on the table does not match with those drawn from the card shoe, a casino employee may instruct the card shoe to retrieve video images of the last cards drawn from the shoe and to display this information on one or more displays at the table. For purposes of explanation, an analogy may be made with a popular method used in sporting events. In some games instant replays are used to determine the validity of a call made by an umpire or referee. For example, in a football game, teams will sometimes challenge the referees to examine instant video replays to determine whether or not a call made during the game was correct. Similarly, if a casino suspects that a card was illegally introduced into the game by a cheating party, they can use the video of cards leaving the shoe as an "instant replay" of sorts to prove that the card on the table did not come from the card shoe. For example, a display device may be comprised of an LED, LCD, PDP, CRT display, electronic paper, or any other display device known in the art. For example, a display device may comprise a dealer display dedicated to interfacing with a dealer and possibly situated at the dealer position, a pit computer, a public display (e.g., a multipurpose tote board at the table game, or a display screen near the table dedicated to playing advertisements, television channels, etc.) a player display intended to interface with one or more players at a table, possibly situated at one or more player positions, etc. In another example, the shoe may transmit video images wirelessly or through a wired connection with a display. Many card shoes presently do not have the capability or devices necessary to take video footage of cards as they are drawn from the shoe. As such, a separate device may be constructed such that it cradles the card shoe. In other words, already existing security devices (e.g., an Angel Eye card shoe) are complimented by a retrofit video collection device.

Figure 9:
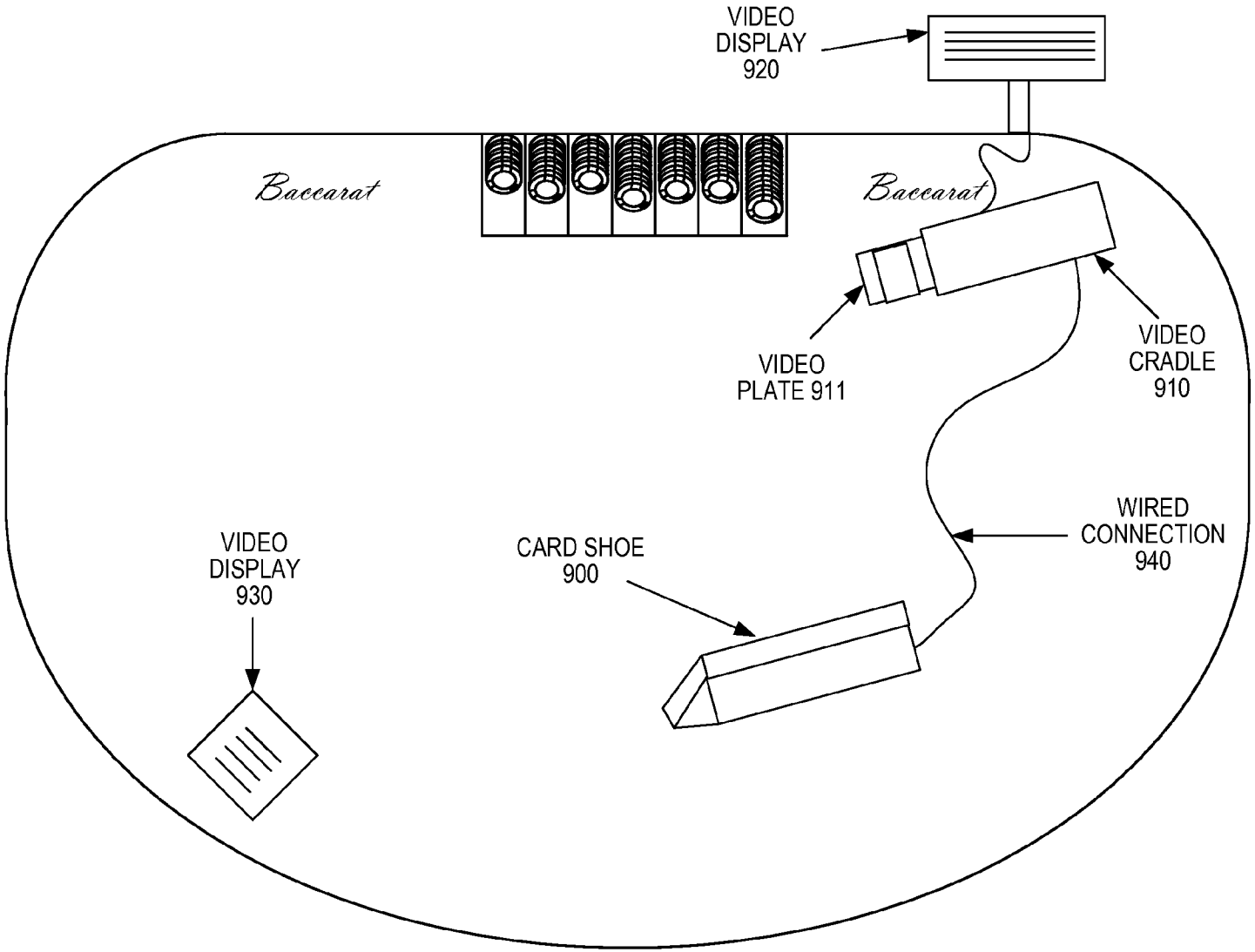
FIG. 9 illustrates an example embodiment of a table game.

FIG. 9 shows one example embodiment of the various devices and components discussed above. For example, Card Shoe 900 may be a typical Smart Shoe, such as the iShoe™ manufactured by ShuffleMaster™, or may be adapted to receive a sealed housing. In some traditional forms of Baccarat, the card shoe is passed to players for a variety of purposes, such as cutting the deck. In order to maintain power supply and security at all times, Card Shoe 900 may be connected to the security system, and possibly Video Cradle 910, via Wired Connection 940. Therefore, even when the shoe is passed from player to player, all of the security measures discussed herein may be operating. When the game is in play, Card Shoe 900 is placed into Video Cradle 910. The card dispensing region of the card shoe fits above or near Video Plate 911 such that when cards are drawn from the shoe, they are passed over the video plate and a video image of each card is obtained.

Again, referring to FIG. 9, if a discrepancy arises wherein it is alleged that an invalid card has been introduced into the game, the dealer or other casino personnel may interface with Video cradle 910, Card Shoe 900, or another electronic device to retrieve video footage of one or more cards drawn from the card shoe. Video playback of such footage may appear on a display device such as Video Display 920, Video Display 930 or any other desired video display.

In some embodiments, players may use this feature at any time to allay any possible suspicions of corruption on the casino's behalf. For example, a player may interface with Video Display 930 at any time to receive video playback of cards being drawn from the shoe.

A table computer or an intelligent card shoe may be set up to cause periodic randomizations of the order of the cards in the shoe or randomizations in the way cards are dealt. This may include periodically shuffling the shoe (e.g., an electronic or mechanical shoe may comprise an automatic shuffler that periodically re-orders the cards in a shoe). For example, some table games employ continuous shufflers that shuffle the cards after each hand in order to (i) keep the cards random and (ii) cut back on the number of decks needed to play the game (e.g., if cards are always in random order, games like blackjack and baccarat no longer require 6 or more decks.

The dealer may randomly burn one or more cards. He or she may burn cards whenever they want to, or the card shoe/table computer may instruct the dealer to burn a card at random (e.g., based on a random number generator). Such instructions may appear on a dealer interface on the table, on the card shoe, on a public display, etc. The time at which a card is burned, the number of cards burned and/or the position from which burn cards are taken may all be random. For example the card shoe may randomly determine to burn the $147^{th}$ card in the shoe.

The deal sequence may also periodically be altered. The standard deal sequence in Baccarat is Player, Banker, Player, Banker, but the table computer may randomly alter this sequence to something like Player, Player, Banker, Banker or Banker, Player, Banker, Player. A display on the intelligent shoe or on a dealer interface may be used to tell the dealer when and how to deal the cards. Multiple cut points may also be used. For example, the cards in the shoe may be divided into thirds and the Dealer may be instructed to deal randomly from the first, middle and final third of the shoe.

In order to verify that cards have not be been observed or tampered with before they arrive at a table game, a set of cards or a card shoe may be packaged with an e-seal that will notify a casino if security has been compromised. For example, on top of plastic or shrink-wrap, the packaging seal might have an electronic or RFID component (seal is "RFID-enabled") that acts as an electronic tampering sensor. For example, RFID "e-seals" may be used to determine, electronically, whether the seal/packaging has been compromised or tampered with. Examples of an electronic/RFID seals: the Sensor Tag 676 manufactured by Savi Technology; and the Sensor-Strap manufactured by Avery Dennison compatible with the TAVIS Data Management Platform manufactured by RF Code INC.

Thus, if the seal is broken before the shoe is opened at the table by the dealer or by the shoe, an indication of the tampering may be stored or transmitted electronically. Electronics within the seal may store an encrypted authentication code. Once the shoe is connected to the table, it can decrypt and authenticate this code. Thus, it would even be difficult for someone to manufacture and substitute an entire replacement shoe without also defeating the encryption scheme.

In one embodiment, a sealed shoe must be connected electronically to the table before opening. For example, a dealer could take a sealed shoe and plug a USB cable into table. Once this is done, an LED may indicate whether it is safe to proceed with using the shoe. If the shoe had been tampered with or opened, the LED would indicate such, and a different shoe would be used.

In some embodiments, an "activation/validation" sequence may occur once the intelligent shoe is connected to the table computer (e.g., via USB). The table computer may determine that the shoe's memory stores a valid encryption key. The table computer may also electronically verify that the shoe has not been tampered with (e.g., an RFID e-seal is intact). If so, an output device (of the shoe or table), may indicate that the shoe is invalid, compromised, or otherwise unusable.

A step in a card manufacturing process may involve sealing one or more decks in secure packaging. The secure packaging may include one or more means for detecting if the cards have been tampered with. In a preferred embodiment, the secure packaging may be removed after being placed within a shoe prior to game play. The shoe itself may be lockable and include an internal mechanism for removing the secure packaging.

For example, card sets may be shuffled prior to being placed within the secure packaging and may be sealed in a foil pack immediately following a manufacturing process. In one example, six decks may be sealed in a single tamper-proof package in a case where the cards are intended to be used in a six deck shoe. This would require only one secure package of cards to be opened in a case of a six deck shoe of blackjack.

Cards may be hermetically sealed in an environment other than air (e.g., Nitrogen) using aluminized packaging. An environment other than air may aid in detecting if secure packaging has been unsealed. An oxygen reactive indicator such as one of the dyes specified in U.S. Pat. No. 4,526,752 (Perlman) may be used to indicate that packaging containing a deck of cards has been unsealed.

In some embodiments, a tamper indicator may be located on a first card in a deck (e.g., oxygen reactive dye printed on first card). In some embodiments, ends of the secure packaging may be sealed using a tamper-resistant method (e.g., ultrasonic welding, chemical bonding). This is in contrast to methods used in sealing food products (e.g., potato chip bags), where the packaging is meant to be easily opened.

A plastic strip with a protruding pull tab may encircle one end of the secure package (e.g., a pull tab as used in Wrigley's Spearmint gum) and serve dual purposes of: aiding in the removal of cards from the secure packaging, providing a visual indication of whether the secure packaging has been opened.

In some embodiments, cards may be shuffled, packaged and shipped at an appropriate angle or incline (e.g., a "trapezoid" formation) such that they can be inserted directly into a shoe and covered before the seal is removed from within the shoe—otherwise, the cards may be subject to human tampering. If cards are not packaged at such an angle, the seal may need to be removed before the cards are placed in the shoe. Otherwise, there may be no physical way to place a non-angled set of cards into a standard shoe without first removing the wrapping, creating a security problem. In many embodiments, the seal is not removed until after the cards have been placed in the shoe and the shoe has been covered. For example, the seal could be removed from the front (through where there cards are removed) after the shoe is covered.

A compatible card shoe may be comprised of six sides (e.g., rectangular, parallelogram side profile), such that cards securely placed within the shoe are unable to be removed other than to be dealt. At least one side of the shoe may be removable to allow for a prepared set of cards to be placed in the shoe. In some embodiments, a card shoe located at a casino may be capable of securely unsealing tamper proof packaging holding a set of prepared cards. In one embodiment, a secure card shoe may have a lockable lid which would prohibit a player/dealer from tampering with cards once they are placed within the shoe. For example, the shoe may have a hinged top with a removable padlock used to prevent opening of the lid. In another embodiment, a card shoe may have one or more openings that may be used by a dealer to remove a seal from a securely packaged card set. For example, a securely packaged deck of cards may be placed within a card shoe, such that pull-tabs protruding from the packaged deck may be accessed once a card shoe lid has been closed. The pull-tabs may be pulled, thus opening the secure set of cards, once the card shoe has also been secured. A card shoe may include an internal cutting device that may be used to remove secure packaging from a set of cards. The cutting device may be automatically activated once a sealed card set is placed within the shoe. Alternately the cutting device may be manually operated (e.g., by a dealer or casino representative.)

In some embodiments, two or more sets of cards may be shuffled/ordered in the exact same sequence prior to being placed within secure packaging. The secure packaging may have an identifier associated with it (e.g., barcode printed on packaging) that may be used to easily identify matching sets of ordered card sets. During game play, a first ordered set may be used for game play, while the second ordered set may be used to confirm that the first set has not been tampered with. For example, as a card from a first ordered set is dealt during game play, a card from a second ordered set is also dealt into a confirmation stack. If the card dealt into the confirmation stack does not match the card being dealt in game play, then a conflict resolution process be initiated (e.g., video surveillance may be reviewed in order to determine if either of the ordered sets had been tampered with.) In some embodiments, the identifier may be printed on the first and/or last card in each secure package, or may be printed on each card within the secure package. The secure package may include more than one deck of cards. For example, two secure packages may each contain 104 cards ordered in the exact same sequence, to be used for a two-deck game of baccarat. The ordered decks may be securely packaged and placed into a shoe according to one or more of the methods outlined herein.

In one embodiment, a first ordered set may be used in a first game of chance and a second ordered set may be used in a second game of chance. Cards from the first ordered set and the second ordered set may be dealt simultaneously during game play. In a game of baccarat, where game play proceeds according to a number of set rules, all outcomes in a first game should match all outcomes in a second. If it is determined that an outcome from a first game play does not match a simultaneous outcome from a second game play, then a conflict resolution process (e.g., video surveillance review) may be initiated.

In another embodiment, one or more decks of cards may be shuffled into a random order and physically connected such that the order of the cards is unable to be changed. In one embodiment, a hole is drilled in the upper left corner of all cards in a deck. A single hardened-steel (or other rigid material) rod may be placed through all of the cards in the deck. Each end of the rod may then have a cap welded onto it (the cap being larger in diameter than the hole in each card), thus preventing any card from being removed from the set without being torn. During game play a card must first be torn from the rod prior to being dealt. A hardened steel washer may be placed between each card on the steel rod. One or more washers that are found next to each other may indicate that a card has been removed from the deck. Hardened steel may be used to prevent easy cutting of the security rod or washer.

Cards may be connected to each other using one or more types of adhesive, with a face of a card being connected to the back of the following card. In order to be dealt, the top card in a deck may be "peeled" off by a dealer or mechanically by the card shoe. A deck that is physically connected in such a manner would greatly reduce a cheater's ability to insert an additional card within the deck during game play. A single-use adhesive may be used, such that once two cards are peeled apart, they are no longer able to be stuck back together. In this embodiment, if a dealer determines that a set of cards was not "glued together" at all points, he may decide to use another deck for game play. A disjointed deck may indicate that one or more cards have been removed or that the set has been reordered. More than one card set (shuffled in a random order) may be physically connected.

One or more security features may be printed on a set of cards prior to the set being used in game play. In one example, the same unique picture or pattern may be printed on the back of each card in a secure deck. In other words, all cards in a card set may be printed with the same picture on the back of each card. The picture may be unique and never reused for another set of cards. In another example, one or more continuous images may be printed on at least one side of a set of cards (e.g., any of four sides of a deck that are perpendicular to the card face/back).

In one embodiment, a pattern printed on the back of a set of cards may be unique amongst all sets used in game play. The unique pattern/picture printed on the back of cards in a first set may be easily discernable from the image printed on the back of a second set. For example, a picture of a first movie star may be printed on a first set and a picture of a second movie star may be printed on a second set. Pictures of the two different movie stars may be much easier to visually discern as "distinct," than two marginally different patterns. A card with a non-matching back that is dealt during game play may visually indicate to a dealer and/or player that a card set has been tampered with. A card manufacturer may keep a record (e.g., historical database) of pictures or patterns that are printed on the back of a set of cards. Prior to printing a unique picture on the back of a set of cards, a controller may compare the unique picture against previously printed pictures in order to ensure that the unique picture is in fact unique (e.g., a unique picture may contain no more than 50% of the same pixels of any other previously used picture.)

In another embodiment, one or more decks of cards may be placed in a random order (e.g. shuffled during a manufacturing process) and have an image printed on one or more of the decks. The image printed on side of card may form a continuous image, such that if any one card is removed or reordered, it would be visually obvious to a dealer, player or casino representative. An image printed on the side of a set of cards may be visible through a clear shoe. A shoe made from a clear plastic such as polycarbonate would allow the pattern to be viewed, but also prohibit anyone from reordering the deck.

In another embodiment, cards may be printed with designs that make it more difficult for the rank of a card to be exposed. Traditionally, playing cards are marked with rank indicia on the upper right and lower left corners of the card. Positioning rank indicia in these corners makes it easy for a person to read a card's rank by only picking up the corner of the card. Consequently, this positioning of the card's rank may also make it easier for a dealer to fan out the corner of a shuffled card set, thereby exposing the value of one or more cards. Therefore, positioning the rank indicia on other parts of a card may make it more difficult for players and or dealers to cheat. For example, rather than printing the rank indicia on the corner of a card, rank indicia may be printed on the middle of a card. In another example, rank indicia may be centered on the top and/or bottom of a card or may be centered on the right and/or left side of a card.

The suit/value of one or more cards within a set may be revealed using a secondary process in addition to being dealt. In one example, a card is removed from a shoe, flipped over and dealt to a banker position in a game of baccarat. To the naked eye, the card face appears to be blank. However, after exposure to an ultraviolet (UV) light, UV sensitive portions of the card are exposed and darken to reveal a King of Hearts. A deck of cards that remains blank until being used for game play could inhibit cheaters from altering a secure set.

Cards may be manufactured with heat sensitive regions that turn from white to dark brown when exposed to a heat source. The heat sensitive regions may be used to display the suit/value associated with a card. For example, an infrared laser located over baccarat table could be used to expose thermal regions (such as those used in thermal fax paper) on the face of a playing card. An unexposed card would appear to be a contiguous blank-white card. Cards may use another exposure method such as UV-sensitive regions on the card/UV light. Cards may additionally or alternatively use an exposure method involving a chemical reaction. For example, a cards suit/value may be printed with one or more inks commonly referred to as "invisible ink." The card may then be exposed to a second chemical during game play to reveal the printed information. The cards may be placed in a random order and securely packaged as described herein.

Shuffling and preparing a set of cards to be used for a card game may take place at a casino or directly at the table where a game is being played (as opposed to at a remote shuffling facility). For instance, an automatic shuffling device at a table game may shuffle a set of cards and then automatically determine sequence information by reading the cards in the shuffled set while the cards are still within the shuffler. A processing device receiving sequence information from the shuffler may also be used to encrypt and/or store the sequence of the card set. In some embodiments, the processing device may be a component of the shuffling device—in others there may be a separate external device or Central Processing Unit (CPU). Thus obtained, the sequence information may then be compared to the values of cards dealt at the table in order to ensure that the set of cards has not been tampered with.

Figure 2B:
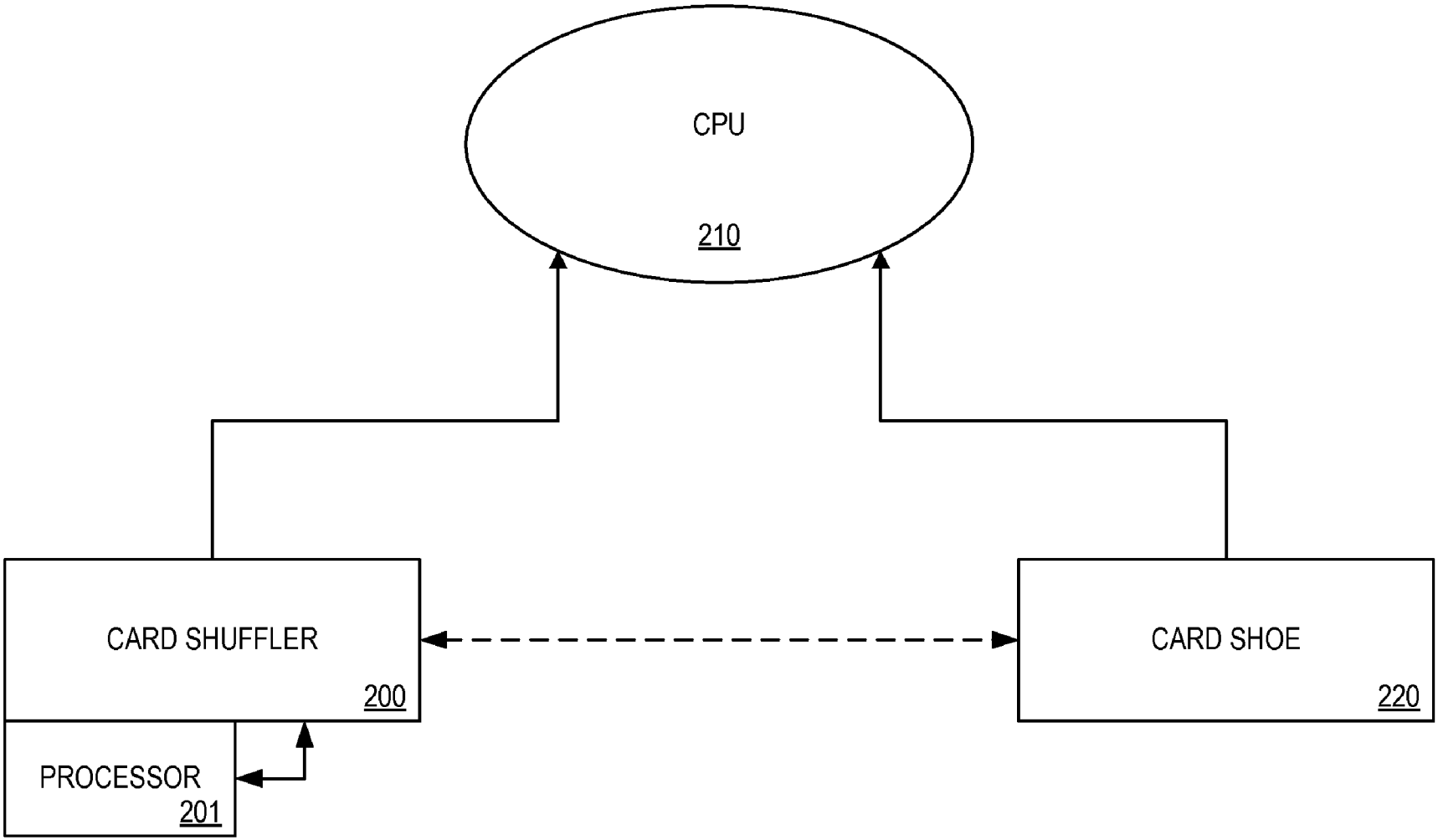

For example, referring to FIG. 2B, Card Shuffler 200 receives a set of cards to be used for a card game from a dealer. Card Shuffler 200 shuffles the set of cards, determines the sequence of the shuffled set and transmits this data to Processor 201 (which may be an internal component of Card Shuffler 200). The sequence information may be encrypted by Processor 201 and/or may be stored in temporary or permanent memory within Processor 201 as well. Sequence information (encrypted or not) may also be transmitted to CPU 210 and stored in temporary or permanent memory. Elements of the networked embodiments, e.g., FIG. 2A, and local embodiments, e.g., FIG. 2B, may be used interchangeably as desired.

Once the sequence information has been encrypted and/or stored, the dealer takes the shuffled card set out of Shuffler 200 and inserts the cards into Card Shoe 220. Card Shoe 220 reads the value of each card as they are taken from the shoe during game play. FIG. 2B shows Card Shoe 220 equipped with a connection to two other devices; Card Shuffler 200 and CPU 210. In one possible scenario, Card Shuffler 200 may receive a dealt card value from Card Shoe 220 and use Processor 201 to compare the value to stored sequence information. In another possible scenario, CPU 210 may receive a dealt card value from Card 220 and compare the value to stored sequence information. In either scenario, the dealt card is either validated or invalidated by CPU 210 or Card Shuffler 200. A validation message may be output once a card has been validated or invalidated, and one or more security measures may also be triggered. In some embodiments, the CPU 210 may be embodied in a housing that receives the cards from the shuffler 200 and that is loaded into the card shoe 220. In some embodiments, the CPU 210 may be contained behind a tamper evident seal of the housing so that the CPU 210 may validate the integrity of the shuffle without allowing the CPU 210 or cards to be accessed while the cards are being transferred from the shuffler 200 to the shoe 220.

By shuffling the cards at the casino or directly at the table, a casino may be able to reduce costs and infrastructure associated with embodiments involving a Remote Shuffling Facility. However, if cards are shuffled in a card shuffler at the table (or in a back room of a casino or other location within a casino) the shuffled set needs to be transferred from the shuffling device to the card shoe. During this transfer, a card set may be exposed to one or more cheating attempts such as card "peeking" or an attempt to insert/replace one or more cards in the shuffled set. Additionally, many games and casinos may also require the set of cards to be cut before being inserted into a card shoe. The act of cutting requires added interaction between the dealer and/or player with a shuffled set of cards, which provides added opportunities for a player and/or casino employee to cheat. The following discusses security measures that be employed to secure the casino against such attacks.

After shuffling, the shuffled set of cards is transferred from the automatic shuffler to the card shoe. During this process, a dealer handling the cards may manipulate the deck (intentionally or unintentionally) and expose cards such that he or another player can discover the sequence of one or more cards in the shuffled set. As discussed above, the shuffler may seal the cards in a container that may be opened by the shoe such that the cards and/or sequence data are not easily accessible. Alternatively, specially designed tools may be used by a dealer or a casino employee to securely transfer cards from a card shuffler to a card shoe, and to cut a deck as well. Referring to FIGS. 3A-3F, a Right Angle Tool (RAT) may be used by a dealer to handle a shuffled card set. A RAT may be made of one or more materials (e.g., metal, plastic, wood, paper, etc.) with two or more separate flat components joined at the ends to form a right angle. The flat portions may be manufactured in any dimension that facilitates handling a set of cards (e.g., the dimensions or one or more portions may resemble the width and/or length of a playing card.)

Figure 3A:
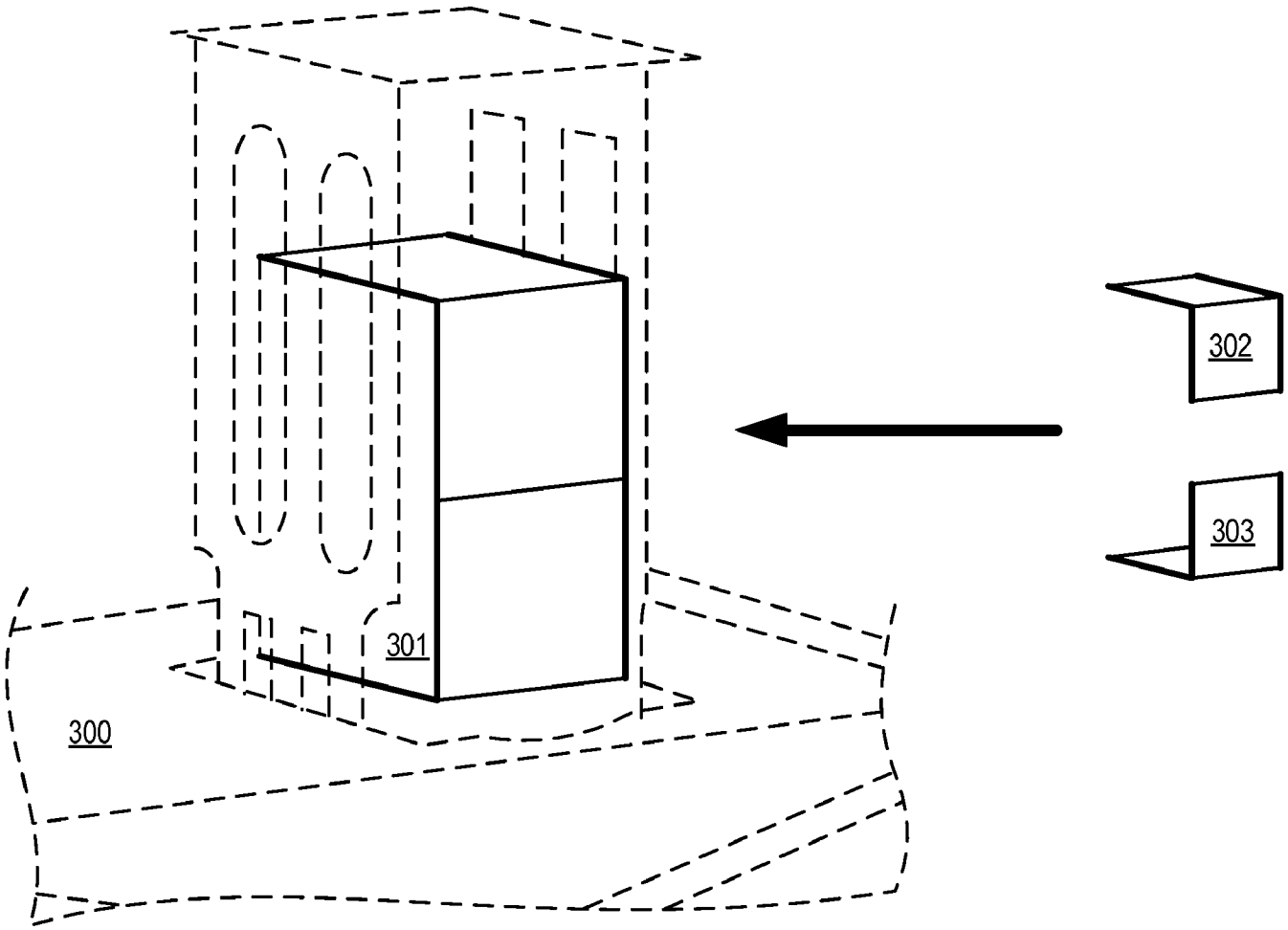
FIG. 3A-3F illustrate an example embodiment of handling a set of cards using right angle tools.
Figure 3B:
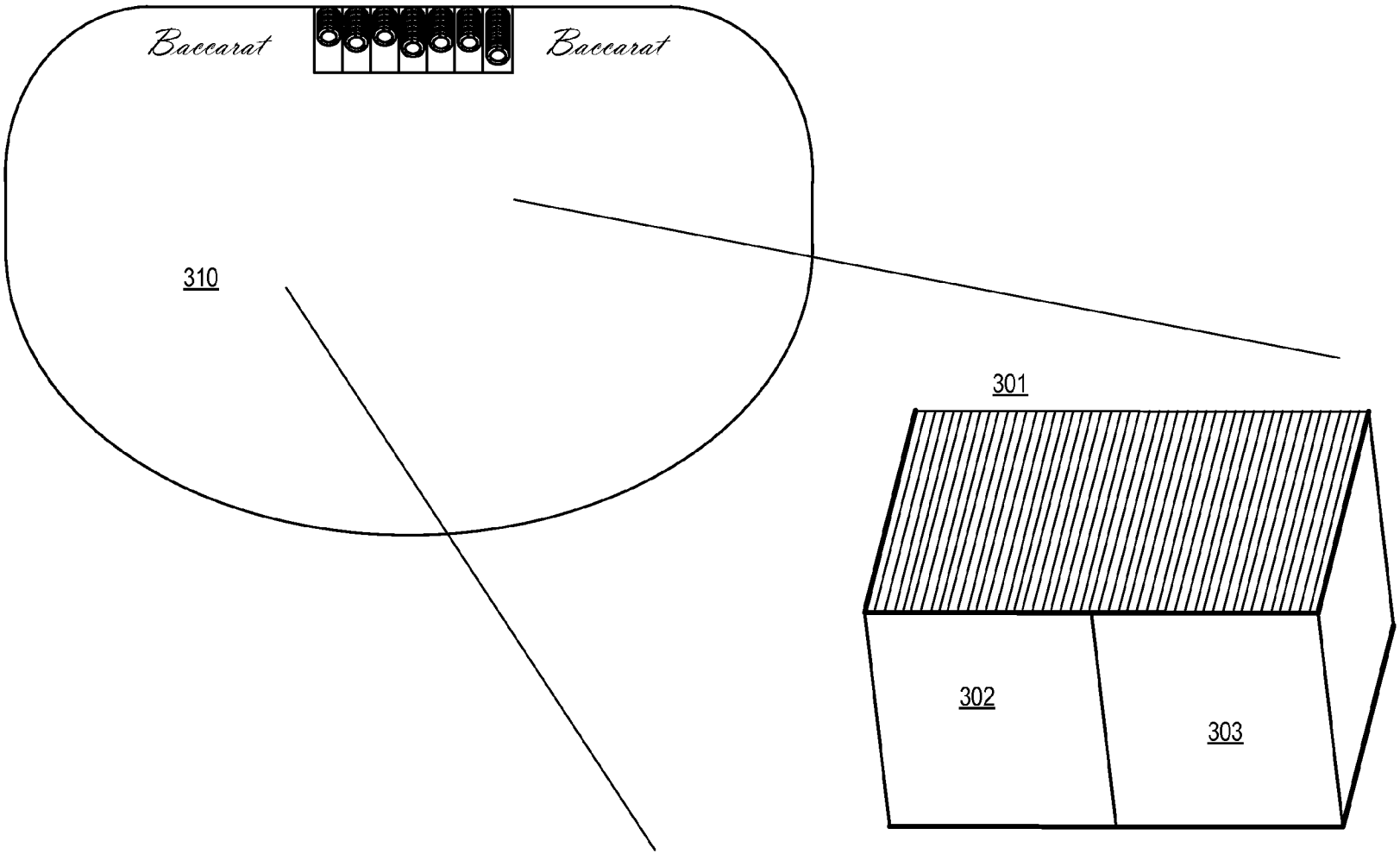
Figure 3C:
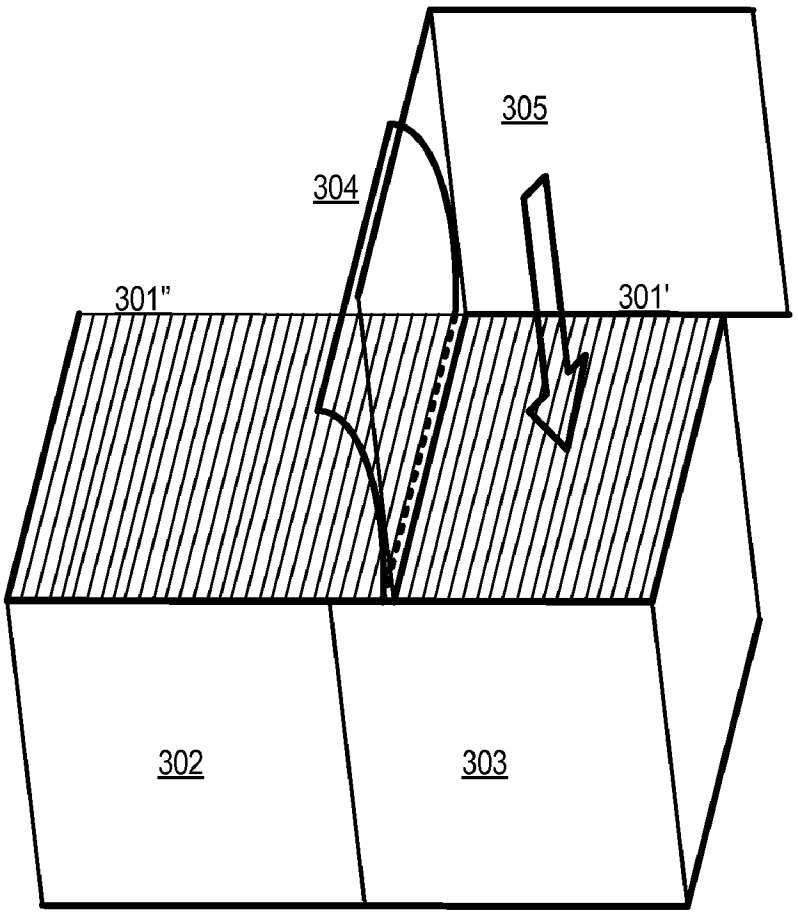
Figure 3D:
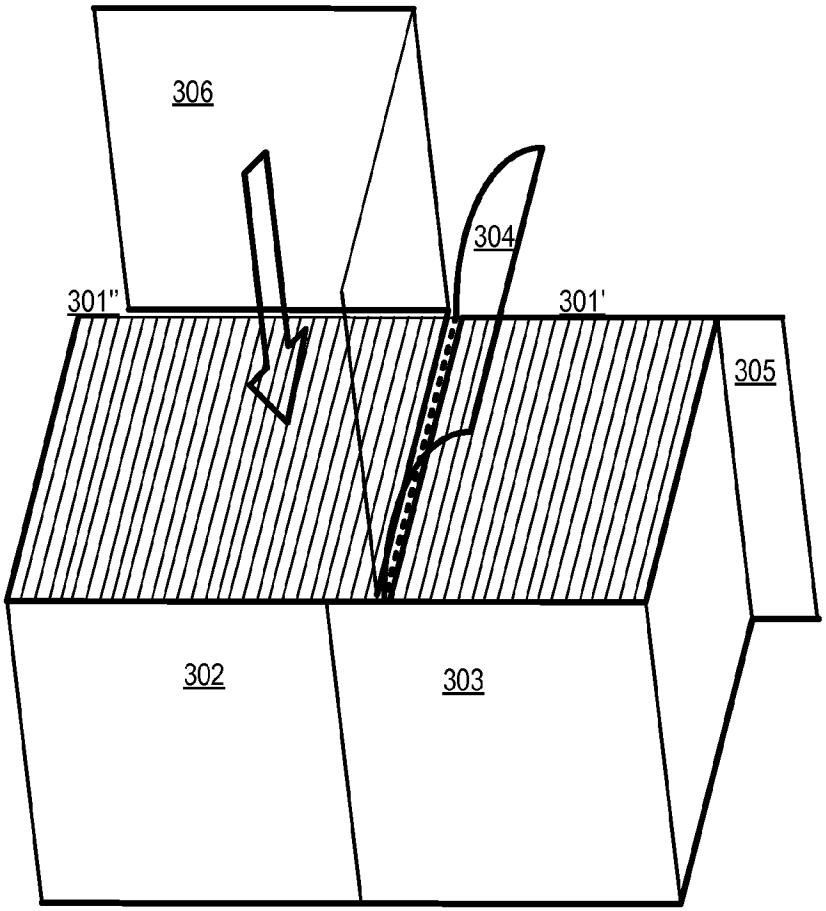
Figure 3E:
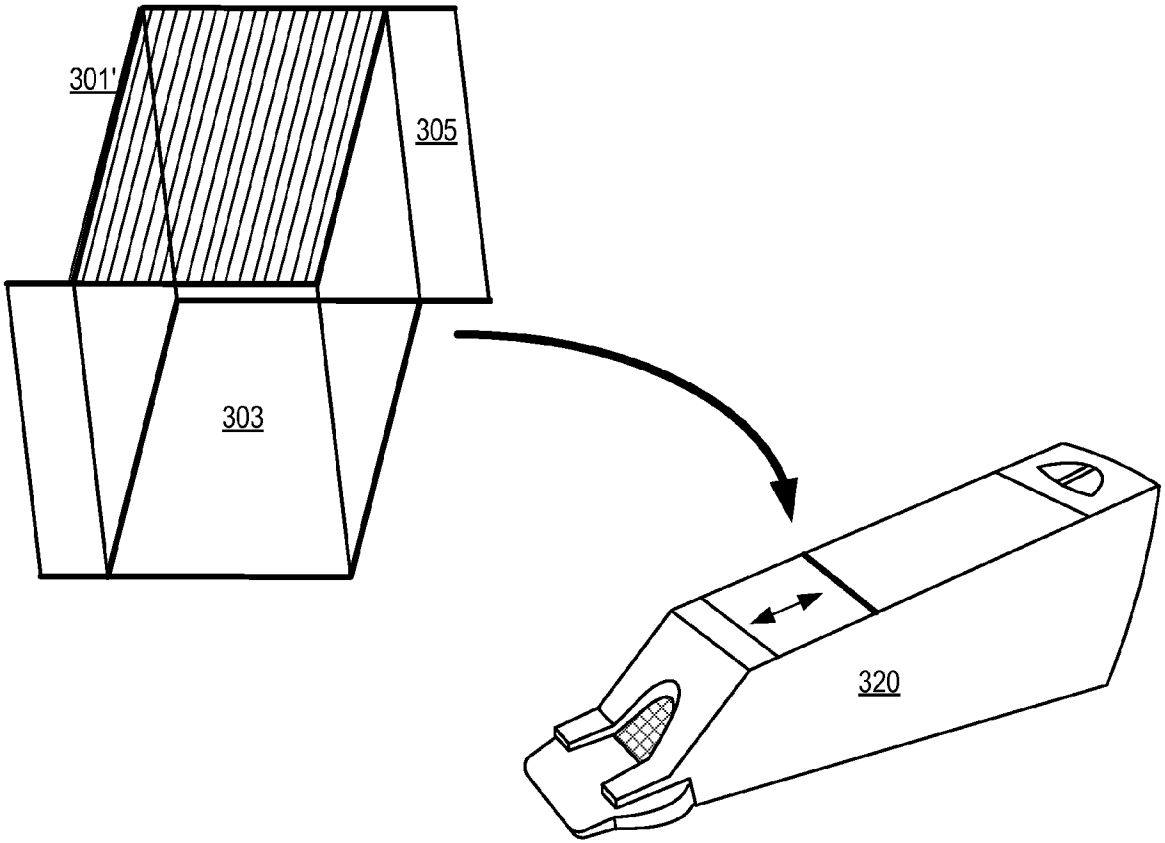
Figure 3F:
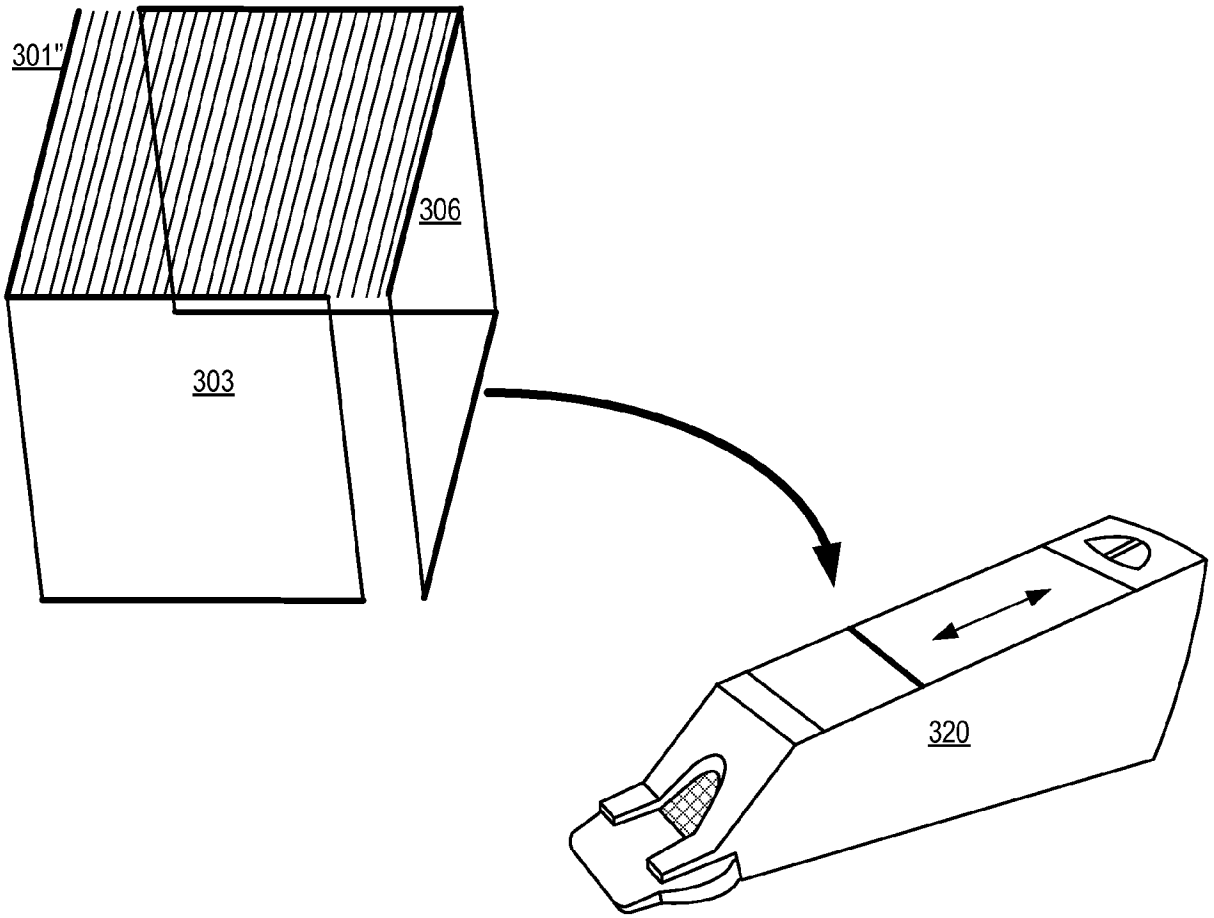

As shown in FIG. 3A, Step 1 involves using two separate RATs 302, 303 to grab the shuffled set of cards 301 and remove them from the shuffler 300. As shown in FIG. 3B, Step 2 involves using the RATs 302, 303 to place on a gaming table 310 and to hold them together. As shown in FIG. 3C, Step 3 involves allowing a player to place a cut card 304 in the set of cards 301. The dealer then uses a third RAT 305 to divide the set of cards 301', 301" where the player placed the cut card 304 (e.g., the third RAT 305 is placed opposite one of the RATs 302 used in Step 1 and 2). Alternatively, the player may cut the set of cards using the third RAT 305 instead of initially cutting the cards with a traditional cut card 304. As shown in FIG. 3D, Step 4 involves using a fourth RAT 306 to secure the remainder of the set of cards 301" (e.g., placed next to the RAT 305 used in Step 3). As shown in FIG. 3E, Step 5 involves moving one of the divided portions 301' of the shuffled set and placing it into the card shoe 320. As shown in FIG. 3F, Step 6 involves moving the remaining cards 301" and placing them into the card shoe 320.

Figure 4B:
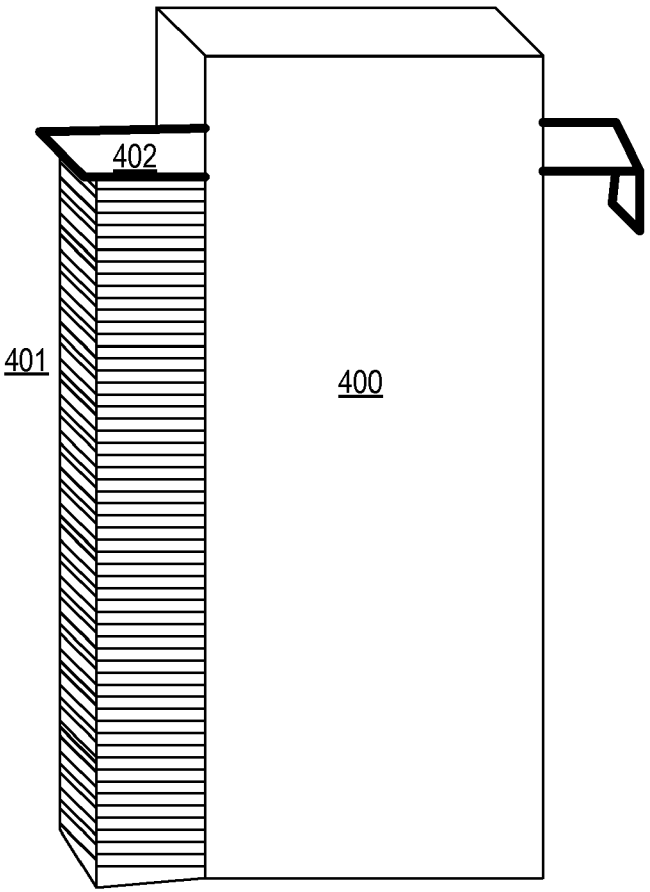
FIG. 4A-4B illustrate an example embodiment of a clamping mechanism.
Figure 4A:
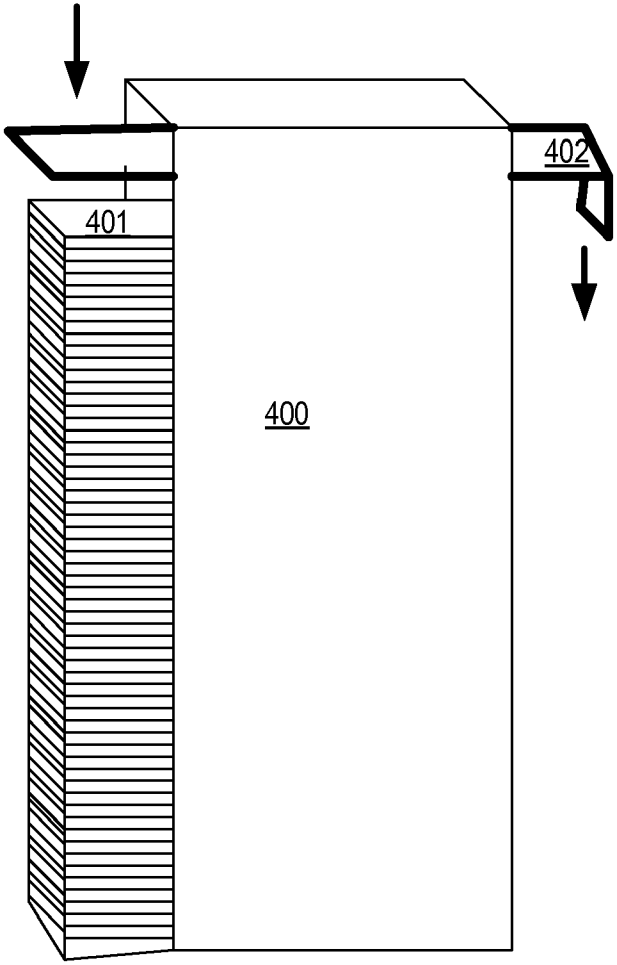

Alternatively, as illustrated in FIGS. 4A and 4B, a customized rectangular receptacle 400 may be used to transfer the cards 401 from the card shuffler to the card shoe. Such a receptacle 400 may be built in dimensions similar to the dimensions of the set of shuffled cards 401. When cards 401 are dispensed from the card shuffler, they are placed directly into the receptacle 400, preferably without a dealer or anyone else touching the cards. The receptacle 400 may have one or more open sides (e.g., the sixth side of a rectangular receptacle may be removed so that cards can be placed inside). Alternatively, the receptacle 400 may have one or more removable sides (e.g., one or more sides of the rectangular receptacle may slide open or be hinged to another side). The cards 401 may then be transferred from the receptacle directly into the card shoe, or cut and then placed directly into the shoe, as discussed below.

As depicted in FIG. 4, the receptacle 400 may have a clamping mechanism 402 extending from two sides used to grab and pull the cards 401 into the receptacle 400. Once the cards 401 are in the receptacle 400, the set may be cut while still inside the receptacle 400.

Figure 5:
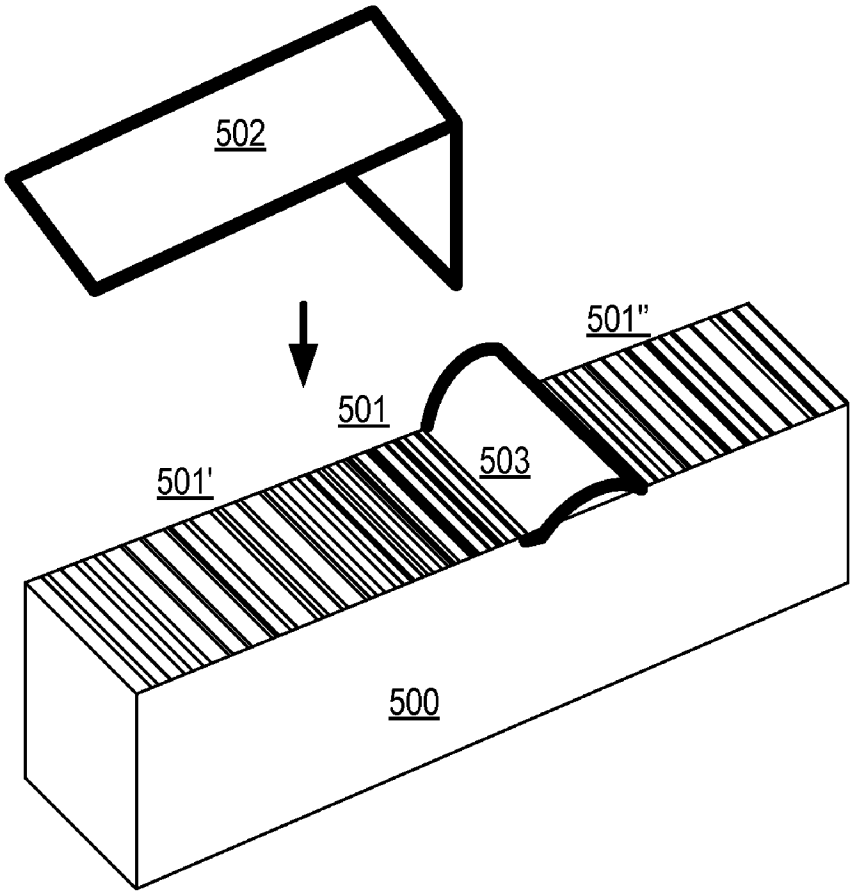
FIG. 5 illustrates an example embodiment of securing a set of cards using a right angle tool.

In another example, as shown in FIG. 5, the open side of a similar receptacle 500 containing a shuffled set of cards 501 may be presented to a player or dealer to place a cut card 503 into a desired position. A RAT 502 may be inserted into the shuffled set 501 where the cut card 503 was placed, and the other side of the RAT 502 may secure a portion of the cards 501' within the receptacle 500. The other cards 501" may be extracted from the receptacle 500 (e.g., using a clamping device or a set of RATs) and placed within the card shoe. The portion of the card set 501' remaining secured within the receptacle 500 by the first RAT 502 may then be extracted from the receptacle and placed within the card shoe as well.

Figure 6:
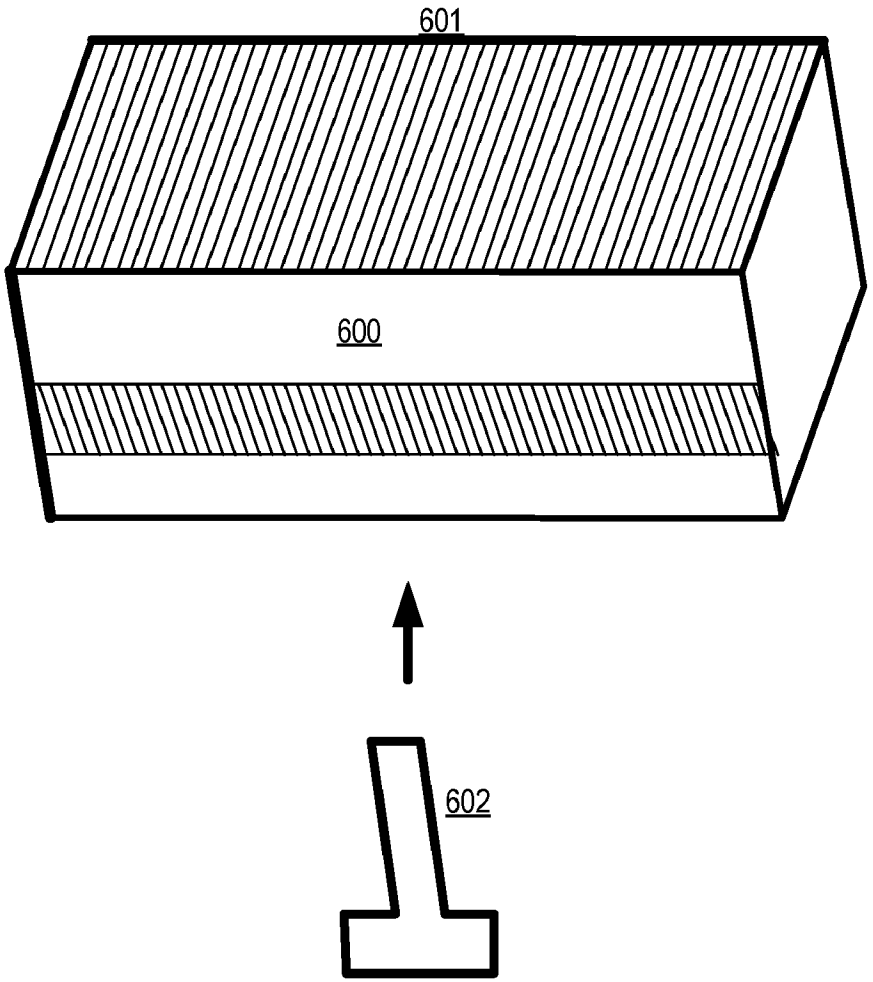
FIG. 6 illustrates an example embodiment of cutting a set of cards using a cutting device.

Another embodiment employing a similar receptacle 600 is shown in FIG. 6. In addition to an open side of the receptacle 600, another side of the receptacle may have an open slit providing access to the cards 601 inside. The cards 601 may be cut using a cutting device 602 that fits through the open slit, preventing the person cutting the card set from having access to the cards 601. The cards 601 may then be split along the cut position and moved into the card shoe as described above.

Figure 7:
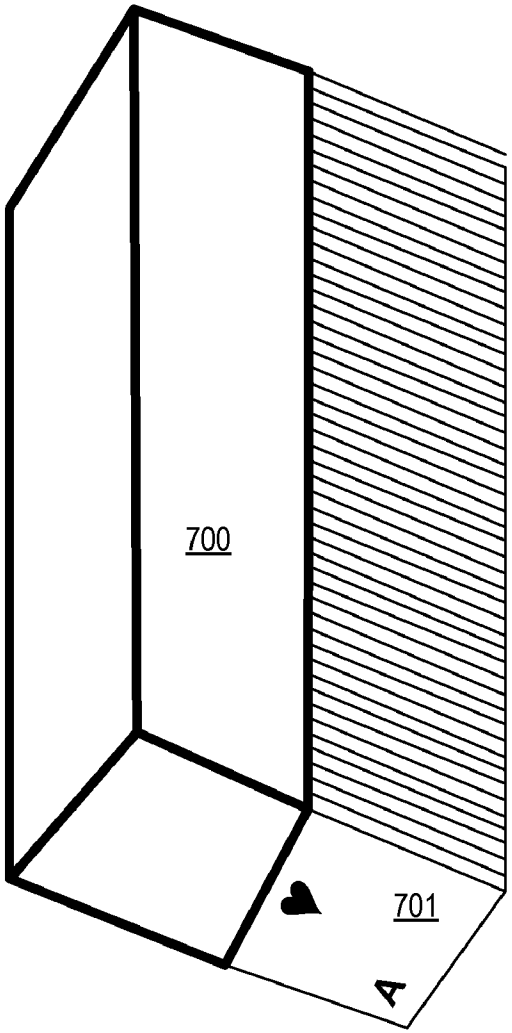
FIG. 7 illustrates an example embodiment of a card set receptacle.

As shown in FIG. 7, a receptacle 701 may be employed such that a portion (e.g., more than one side of the set) of a shuffled set of cards 701 is exposed. The exposed portion may allow the player or dealer easier access to the cards 701 within the receptacle 700 to facilitate cutting and transfer from the receptacle 700 to the card shoe.

Figure 8B:
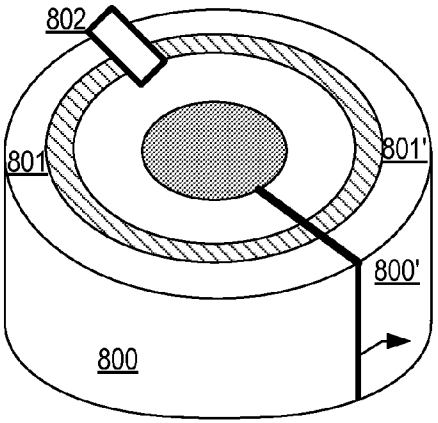
FIG. 8A-8D illustrate an example embodiment of a pliable receptacle.
Figure 8D:
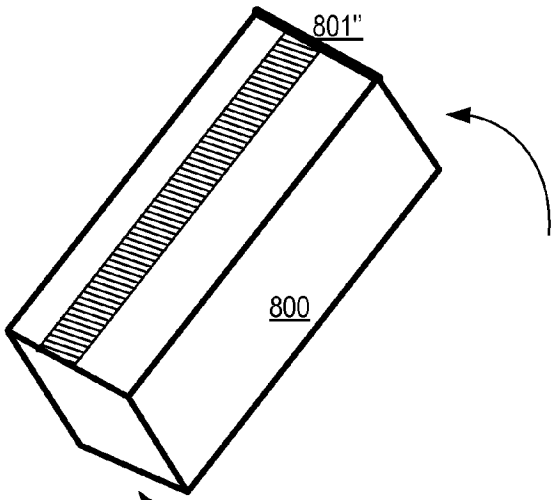
Figure 8A:
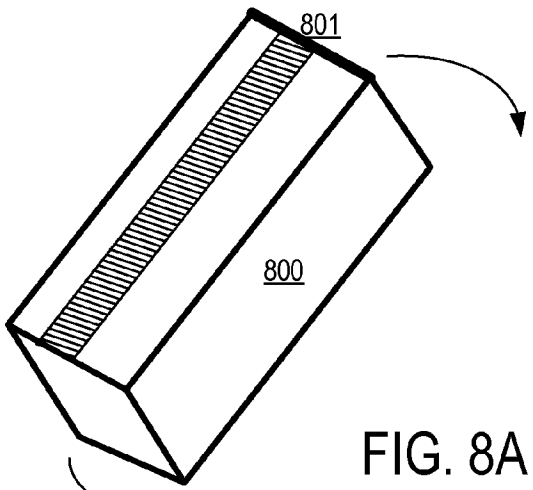
Figure 8:
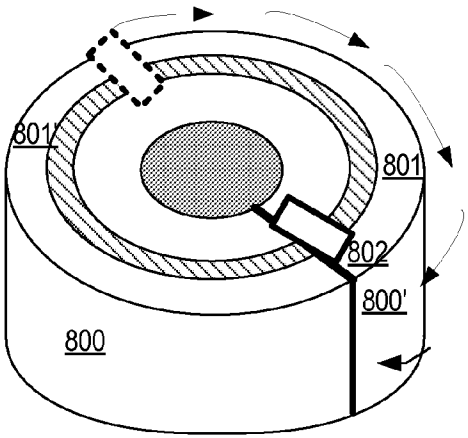

As shown in FIG. 8, a receptacle may be employed such that it is pliable and can be bent into a continuous shape or sequence (e.g., circular or in the shape of an oval) by meeting the front and the back of the set of shuffled cards. A player may insert a cutting tool to designate a cut position in the shuffled set of cards. After the cut position has been designated, each end of the receptacle may be removed, uniting the continuous set of cards. The cards may then be pushed around the circular receptacle until the designated cut position is at one end of the receptacle. The receptacle may then be straightened, and the cards may then be transferred directly into the card shoe.

FIG. 8A depicts a pliable receptacle 800 with a narrow opening similar to the one described in FIG. 5. As shown in FIG. 8B, a first pliable receptacle 800 having a first set of cards 801 may be curved into a semicircle and mated with a complimentary receptacle containing a second set of cards 801'. A cutting card or device 802 may be inserted into one of the sets of cards 801, 801' and, as illustrated in FIG. 8C, may rotate sets 801, 801' within the two receptacles 800, 800'. As shown in FIG. 8D, the receptacle 800 (and 800' (not shown)) may be straightened and a hybrid set of cards 801" containing portions of both original sets 801, 801' may be placed into a card shoe.

A number of variants of the above embodiments are possible. For example, a clamping device can be secured to the top and bottom of the stack of shuffled cards within the shuffling device. The dealer then handles the clamping device when transporting the cards without ever physically touching the card stack. If a clamping device is used to transport the cards from a shuffler to a card shoe, the cards may still need to be cut before being inserted into the card shoe. In such a case, one or more smaller clamping devices or RATs may be used to cut the card set, split the card set at a designated cut position, and insert the cards into the shoe, as described above.

In yet another example to prevent card peeking, the cards may be cut and then placed in separate shoes. For example, the shuffled set of cards may be cut while still in the dispensing mechanism of the shuffling device. For example, after determining an appropriate cut position, one or more clamps or RATs may be used to separate the two portions of the stack and used to transport and insert these sets into separate shoes. Cutting the card set while it is still within the card shuffling dispensing mechanism eliminates some of the opportunity a player or dealer may have to peek at the card values (e.g., cards are not taken out of the shuffler, placed on the table in front of a player, moved in front of the dealer and then separated by the dealer).

Additionally, having two shoes also cuts down on the necessity of shifting the order of the set of cards after it has been cut (traditionally, the cards are cut, then the cards after the cut are placed into the shoe first and the cards before the cut card are then arranged in the back of the shoe). Instead, the cut is made in the dispensing mechanism of the shuffler, the top portion is placed in one shoe, and the bottom portion is placed in another shoe. Dealing through one shoe first and then dealing from the other shoe second simulates the traditional re-ordering of cards, which consists of one portion of the set being placed in the same shoe behind the other.

One or more cameras may be embedded in the table (e.g., the edges of the table, facing the center of the table or the dealer position). Additionally, on or more cameras may be embedded or fitted onto one or more devices used at the table (e.g., the card shoe, card shuffler, one or more displays, etc.) These cameras may be used to detect if a dealer is handling cards in a manner that exposes cards within the set. For example, cameras may face horizontally across the table and be focused on the area where cards would be handled during card transfer. The video from these cameras may be monitored automatically by a computer or by a human to ensure that the dealer has not exposed the face of any of the cards in the set during transfer.

While the above steps and devices are intended to prevent the dealer from exposing cards during transfer, they may also prevent cards from being surreptitiously inserted or substituted into the deck. The following steps and devices may prevent or reduce the possibility of card insertion or substitution. For example, many devices and embodiments described above are designed to compare cards dealt from the shoe with an encrypted sequence of cards which will detect inserted cards. A weight sensor within the card shoe may be used to measure the weight of the cards placed within the card shoe. This measurement may be compared to a predetermined card set weight, and an alarm or invalidation message may be output if the measurements do not match. This process would therefore detect if any extra cards introduced during the card transfer. An image or marking can be made on one edge of a set of shuffled cards forming a continuous image (e.g., a stamped image or a line drawn with a writing tool). Once cards are inserted into the card shoe, cameras within the shoe may verify if the continuous image or markings have been broken or altered.

After the cards have been shuffled, an adhesive strip (e.g., a removable sticker) may be applied to one or more edges of the shuffled card stack. The adhesive bonding may protect against card insertion during transfer and may also be removed after cards have been placed within the shoe. For example, the adhesive strip may be completely wrapped around a shuffled set of cards covering at least four sides of a rectangular stack of cards. If the deck is to be cut before being inserted into the card shoe, a cutting device may be sharp enough to cut through the adhesive strip placed around the stack, thus forming to separately bonded set of cards. Each set may then be individually inserted into the shoe. The adhesive strip may be removed while the cards are in the shoe by using one of the methods of removing a seal mentioned above.

In some embodiments, an optical discard tray may be used to reconcile the amount of cards discarded with those that have been dealt on the table. Additionally, cards remaining in the card shoe after the cut card has been reached may be input into the discard tray to confirm that all cards are accounted for or that no cards have been illegally introduced.

In one embodiment, discards may be fed into a slot which automatically reads the cards to reconcile discard data with the cards that are or should be in the card shoe. Cards may be inserted into a discard tray manually by the dealer or they may be automatically fed by machine components. For example, a discard slot may be equipped with rollers that feed each card individually into the discard tray, which may be a container inside the table). Rollers and automatic feed devices may be especially important for a game of Baccarat because cards are frequently mangled, crumpled, torn, etc. Rollers and individual feeding devices may help to flatten or re-orient cards back into a manageable shape for accounting purposes. Examples of rollers or automatic feed devices may be found in U.S. Pat. No. 5,600,362 to Morgavi, which is incorporated by reference herein. The Morgavi patent describes methods of feeding cards for the purposes of printing; such devices however may be used for purposes discussed herein as well.

In some embodiments, cards may be counted in order to ensure that all of the cards are accounted for. For example, an 8-card shoe comprises 416 cards. A counting device may determine if too few or too many cards exist, in which case a card would have been extracted or inserted, respectively. Cards may be counted by a weight sensor (discussed above) or by other known counting methods. Additionally, cards may also be scanned in order to determine the rank and suit of each card discarded. Therefore, substitutions may be detected by counting the number of cards of each suit and rank. (e.g., there should (only) be 8 Aces of hearts, 8 Aces of spades, etc). The remaining cards in the shoe after the cut card has been reached may be placed/fed into the discard tray to account for the cards that have not been dealt during play.

The dealer's protocol may be a simple method to ensure that no cards are inserted, extracted or substituted from a card shoe. Below are some example protocols that may be introduced and monitored by security personnel. For example, casino or third party security personnel may watch a video feed to detect breaks in protocol. If the proper protocol is not performed, the card shoe may be invalidated and a message may be sent to the table, as discussed above. Dealer may be required to flatten his hands above the table, spread his finger, and rotate his hands 180 degrees twice before and after each time he or she touches the cards or the shoe. Dealer may be required to wear white gloves when handling cards during card transfer. Dealer may not be allowed to be approached by anyone within 2 feet during card transfer. Any of the processes of transferring and cutting cards may be governed by strict protocol which may be monitored by security personnel.

Similar to the rectangular receptacle discussed above, a cut box may be built into a special position on the table. The cut box is a place where cards are placed while being cut and during transfer from the shuffler to the shoe. The cut box is equipped with weight sensors that can detect fluctuations in thousandths of ounces, thereby detecting if a card has been removed or inserted into the shuffled set. Cards may be taken out of the shuffler by the dealer and placed into the cut box. The weight may be determined and compared to the standard weight of a shuffled set to determine validity. A green light may flash after validation, notifying the dealer that he or she may have a player cut the cards. After the cut, the weight sensor may again validate the weight of the set of cards, this time accounting for the weight of the cut card. Once the green light has been flashed the dealer may proceed. If the light does not flash, or flashes a different color, them the set has been invalidated. In addition to lights, other validation signals may be used such as audio signals or tactile signals or any kind of visual signals.

The steps discussed above protect the physical cards from being manipulated or at least greatly reduce the possibility of this occurring—steps to thwart attempts at intercepting electronic sequence data are also contemplated. For example, sequence data may be immediately encrypted within the card shuffling device and any unprotected data is immediately deleted from RAM. The system may be set up such that data can only be transmitted from the shuffling device to connected devices. This prevents an attacker from hacking into memory or processors within the shuffling device containing unencrypted sequence data. The shuffling device and card shoe may also operate independent of a network or an exposed CPU device. Data may therefore be transferred via a wired connection between the wired devices only. Thus, a hacker as no point of access to the data. The steps and devices above used to prevent peeking and card insertion/substation may be independently evaluated, alone and in combination as providing adequate security depending on a calculated risk level, thus eliminating the need for electronic data transfer and associated hacking dangers in circumstances where the risk analysis dictates.

In some embodiments, set of cards may be time stamped or labeled with an expiration date. Such a step may increase the level of security for a set of cards by shortening the length of time a cheating party would have to successfully determine the sequence of a shoe. For example, even if someone were to somehow able break an encrypted hash value of a card sequence, it would take an a set amount of time even if they had an incredibly large amount of computing power. Therefore, if a set of cards were to expire (e.g., a casino is not allowed use a set of cards after a certain time or date) then it would further prevent people from being able to cheat the game by determining a card sequence.

In some embodiments, when validating a card sequence, indicia on a playing card other than rank or suit information may be scanned or detected by the shoe. For example, each card of a set may have an order number (which may be encrypted in a barcode or a serial number, etc.) printed on the physical card. This information may be checked by the scanning device. In one embodiment, the cards may be printed with a sequence number, e.g., 1,2,3,4,5 . . . . Then if someone were to try insert cards into a card set, they would alter the card order, which is not only electronically detectable, but also easily visually detectable. For example, the dealer can see that the order is out of sequence such as 154, 155, 156, 163, 157. Also, someone inserting cards would have to remove the cards labeled with the same sequence, or a duplicate pattern would appear. For instance, if the player inserted 3 cards into a set without removing the appropriately ordered cards, then the dealt sequence numbers may look like the following: 25,26, 27, 28,29,30,28,29,30, 31, 32.

Instead of physically shuffling a set of cards at remote facility, a remote facility may generate a virtual shuffle. This virtual shuffle may be a sequence that the cards would be in if they were to be shuffled by a shuffling machine at the remote facility. For example the remote facility may determine that the cards should be in order Ah, 10c, Jd, 2c, 7h, 8s, etc and then transmit this information to a card shuffling device at the casino. The shuffling device may then order the cards according to the sequence provided by the remote facility. The shuffler may be either in the back room of a casino, which would then take steps necessary to prepare the cards for table game use, or it may be a component at the live table (e.g., the dealer places cards in a card shuffler at the table and the shuffler orders the cards according to the received sequence.) In some embodiments, the sequence of the physically dealt cards may still be validated to prevent from someone physically corrupting the determined order (e.g., by inserting cards into the card set).

What is claimed is:

1. A gaming table comprising:

a support structure;

a table top supported by the support structure, said table top configured such that each of a plurality of plays of a wagering game can be played on the table top;

a card dispensing device supported by the support structure;

at least one processor; and at least one memory device which stores a plurality of instructions, which when executed by the at least one processor, cause the at least one processor to operate with the card dispensing device to:

(a) cause the card dispensing device to receive at least one randomly shuffled deck of playing cards;

(b) cause the card dispensing device to receive data representing an identified sequence of the playing cards of the received at least one randomly shuffled deck of playing cards, said data being stored in association with at least one storage device;

(c) determine if the received at least one randomly shuffled deck of playing cards is validated by comparing a determined sequence of a plurality of the playing cards of the received at least one randomly shuffled deck of playing cards to the identified sequence of the playing cards;

(d) if the received at least one randomly shuffled deck of playing cards is determined to be validated, enable the card dispensing device to dispense at least one of said playing cards for at least one of the plays of the wagering game; and (e) if the received at least one randomly shuffled deck of playing cards is determined to be invalidated, provide an indication that the received least one randomly shuffled deck of playing cards is invalid.

2. The gaming table of claim 1, wherein the data representing the identified sequence is encrypted.

3. The gaming table of claim 1, wherein the received at least one randomly shuffled deck of playing cards is associated with a tamper evident seal configured to limit access to the received at least one randomly shuffled deck of playing cards.

4. The gaming table of claim 3, wherein the card dispensing device is configured to open the tamper evident seal.

5. The gaming table of claim 1, wherein the gaming table includes at least one display device supported by the support structure.

6. The gaming table of claim 5, wherein when executed by the at least one processor if the received at least one randomly shuffled deck of playing cards is determined to be invalidated, the plurality of instructions cause the at least one processor to operate with the at least one display device to display the indication of said invalidation.

7. The gaming table of claim 1, wherein when executed by the at least one processor if the received at least one randomly shuffled deck of playing cards is determined to be invalidated, the plurality of instructions cause the at least one processor to thereafter prevent the card dispensing device from dispensing any of said playing cards for any of the plays of the wagering game.

8. A method of operating a gaming system, said method comprising:

(a) causing a card dispensing device to receive at least one randomly shuffled deck of playing cards;

(b) causing the card dispensing device to receive data representing an identified sequence of the playing cards of the received at least one randomly shuffled deck of playing cards, said data being stored in association with at least one storage device;

(c) causing at least one processor to execute a plurality of instructions stored in at least one memory device to determine if the received at least one randomly shuffled deck of playing cards is validated by comparing a determined sequence of a plurality of the playing cards of the received at least one randomly shuffled deck of playing cards to the identified sequence of playing cards;

(d) if the received at least one randomly shuffled deck of playing cards is determined to be validated, enabling the card dispensing device to dispense at least one of said playing cards for at least one play of a wagering game; and (e) if the received at least one randomly shuffled deck of playing cards is determined to be invalidated, causing the at least one processor to execute the plurality of instructions to provide an indication that the received at least one randomly shuffled deck of playing cards is invalid.

9. The method of claim 8, wherein the data representing the identified sequence is encrypted.

10. The method of claim 8, wherein the received at least one randomly shuffled deck of playing cards is associated with a tamper evident seal configured to limit access to the received at least one randomly shuffled deck of playing cards.

11. The method of claim 8, which includes causing the at least one processor to execute the plurality of instructions to operate with at least one display device to display the indication of said invalidation if the received at least one randomly shuffled deck of playing cards is determined to be invalidated.

12. The method of claim 8, which includes preventing the card dispensing device from dispensing any of said playing cards for any of the plays of the wagering game if the received at least one randomly shuffled deck of playing cards is determined to be invalidated.

13. A gaming system comprising:

a container configured to transport at least one randomly shuffled deck of playing cards, said at least one randomly shuffled deck of playing cards associated with data representing a predetermined identified sequence of playing cards;

a card dispensing device configured to receive the at least one randomly shuffled deck of playing cards from the container and to receive the data representing the predetermined identified sequence of playing cards; and at least one processor programmed to operate with the card dispensing device to determine if any of said playing cards to be dispensed from the received at least one randomly shuffled deck of playing cards violates the predetermined identified sequence of playing cards by comparing a determined sequence of a plurality of the playing cards of the received at least one randomly shuffled deck of playing cards to the predetermined identified sequence of playing cards.

14. The gaming system of claim 13, which includes a tamper evident seal connected to the container and configured to limit access to the at least one randomly shuffled deck of playing cards within the container.

15. The gaming system of claim 14, wherein the tamper evident seal is configured to be opened by the card dispensing device.

16. The gaming system of claim 13, wherein the container is configured to enable the card dispensing device access to the at least one randomly shuffled deck of playing cards.

17. The gaming system of claim 13, wherein the predetermined identified sequence includes a coded sequence.

18. The gaming system of claim 17, wherein the coded sequence is encrypted.

* * * * *

UNITED STATES PATENT AND TRADEMARK OFFICE

CERTIFICATE OF CORRECTION

PATENT NO. : 8,408,550 B2
APPLICATION NO. : 12/936642
DATED : April 2, 2013
INVENTOR(S) : Walker It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 181 days.

Signed and Sealed this
Nineteenth Day of November, 2013

Teresa Stanek Rea

Teresa Stanek Rea
*Deputy Director of the United States Patent and Trademark Office*